United States Patent [19]

Rudy

[11] 4,183,156

[45] Jan. 15, 1980

[54] INSOLE CONSTRUCTION FOR ARTICLES OF FOOTWEAR

[75] Inventor: Marion F. Rudy, Northridge, Calif.

[73] Assignee: Robert C. Bogert, Woodland Hills, Calif. ; a part interest

[21] Appl. No.: 830,589

[22] Filed: Sep. 6, 1977

Related U.S. Application Data

[63] Continuation-in-part of Ser. No. 759,429, Jan. 14, 1977, abandoned.

[51] Int. Cl.[2] ..... A43B 13/38; A43B 13/20; A61N 0/00

[52] U.S. Cl. ..... 36/44; 36/29; 128/383

[58] Field of Search ..... 36/28, 29, 35 R, 35 B, 36/71, 88, 93, 96, 44; 264/299, 230, 234, 319; 128/90, 382, 383; 2/2.5, 413, 414, DIG. 3, DIG. 10

[56] References Cited

U.S. PATENT DOCUMENTS

| | | | |
|---|---|---|---|
| 1,304,915 | 5/1919 | Spinney | 36/29 |
| 2,037,230 | 4/1936 | Hack | 36/29 |
| 2,080,469 | 5/1937 | Gilbert | 36/29 |
| 2,189,813 | 2/1940 | McGuire | 36/29 |
| 2,739,093 | 3/1956 | Bull | 36/29 |
| 3,410,004 | 11/1968 | Finn | 36/71 |
| 3,589,037 | 6/1971 | Gallagher | 36/44 |
| 3,760,056 | 9/1973 | Rudy | 36/71 |
| 3,872,511 | 3/1975 | Nichols | 2/413 |

FOREIGN PATENT DOCUMENTS

| | | | |
|---|---|---|---|
| 1018215 | 10/1952 | France | 36/29 |

*Primary Examiner*—Patrick D. Lawson
*Attorney, Agent, or Firm*—Subkow and Kriegel

[57] ABSTRACT

An improved construction for articles of footwear, such as boots and shoes of all types, includes an inflated insert, preferably in the shape of an insole, having a multiplicity of intercommunicating, gas containing chambers, and a ventilated moderator member which overlies the inflated insole for evenly distributing the forces exerted by the gas containing chambers across the plantar surface of the foot of the wearer. The material from which the insole is constructed and the gas contained in the intercommunicating chambers of the insole member are selected so that the rate of diffusion of the gas through the barrier material of the insole will be extremely slow, the insole remaining inflated to a substantial pressure for several years. The pressure to which the intercommunicating gas containing chambers are inflated is selected so that the insole will support the foot in a comfortable manner, distribute the load on the foot across the plantar portion of the foot, with no unusually high pressure points on the foot, and absorb shock forces experienced during walking, jumping or running to protect the bones of the foot and body and the various body organs. In addition, energy is absorbed, stored, and returned as motivating energy to the foot, leg and body in such manner as to make walking, running and jumping more efficient and less tiring.

45 Claims, 41 Drawing Figures

FIG. 36. PRESSURE REDUCTION DUE TO STRETCHING OF THE ENVELOPE
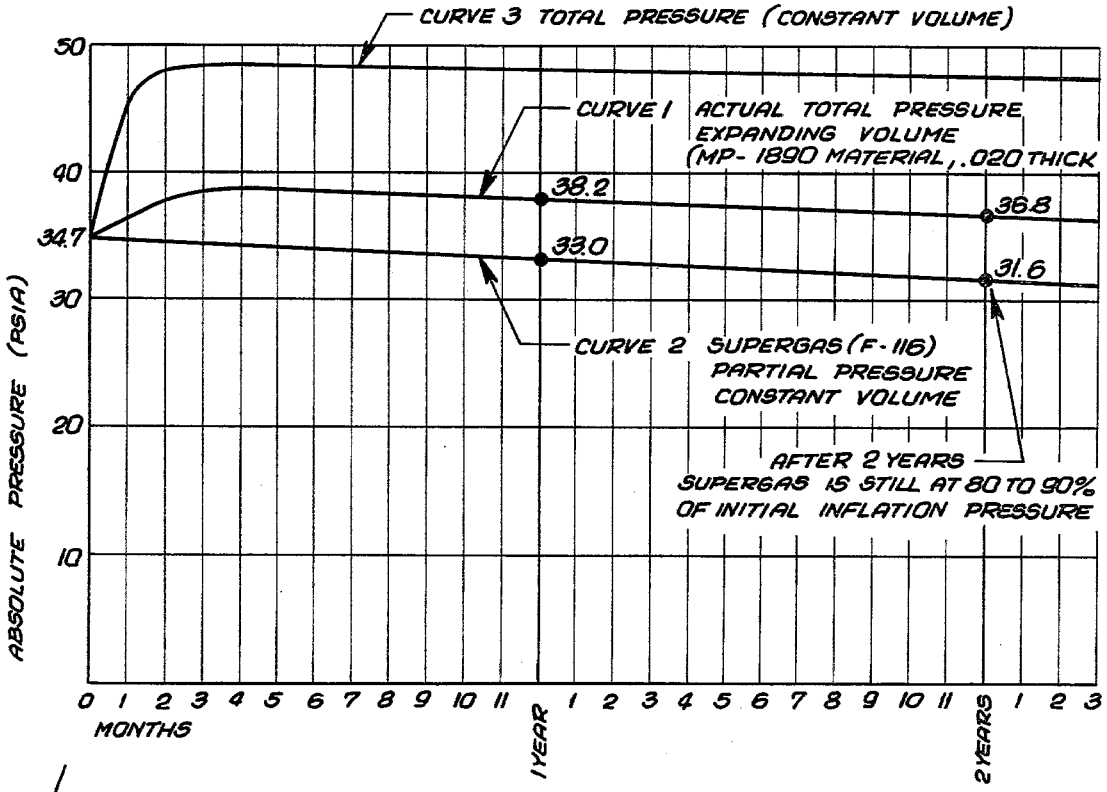
FIG. 37. COMPARISON OF AIRSOLE RATE OF VOLUME GROWTH DUE TO TENSILE RELAXATION OF PLASTIC ENVELOPE WITH INTERNAL PRESSURE RISE DUE TO REVERSE DIFFUSION OF AIR
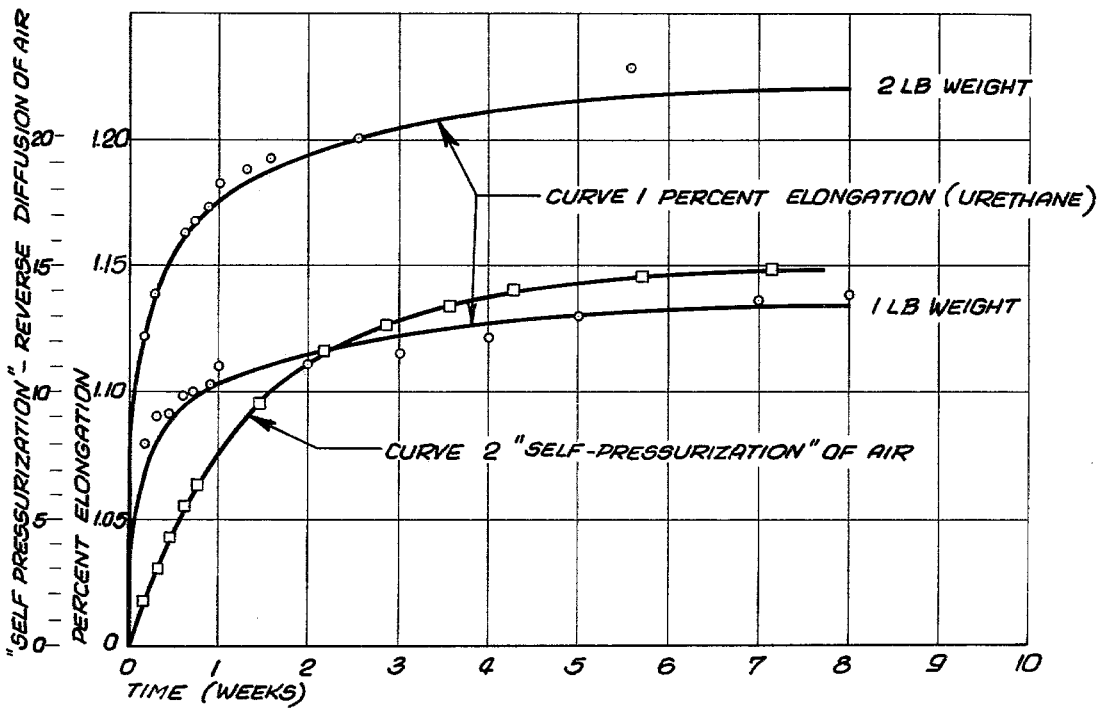

SELF-PRESSURIZATION & SUPERGAS INFLATION (F116)
URETHANE FILM (MP-1890, .020)
ACTUAL PRESSURES (GAGE) WITH EXPANDING VOLUME

"SELF-INFLATION" DUE TO REVERSE DIFFUSION
LOW PRESSURE ENCLOSURES

INSOLE CONSTRUCTION FOR ARTICLES OF FOOTWEAR

This application is a continuation-in-part of application Ser. No. 759,429, filed Jan. 14, 1977, now abandoned for "Improved Insole Construction for Articles of Footwear."

The present invention relates to inserts, such as insoles, for articles of footwear, and more particularly to an improved inflated insert construction that firmly and comfortably supports the foot of a wearer.

Numerous insoles for articles of footwear have been designed in the past in an attempt to provide a comfortable support for the human foot. Many of these proposed prior art insoles have been designed to contain a fluid, either liquid or gas. Gas filled insoles are shown, for example, in U.S. Pat. Nos. 900,867; 1,069,001; 1,304,915; 1,514,468; 1,869,257; 2,080,469; 2,645,865; 2,677,906; and 3,469,576.

However, none of the prior art fluid-filled insoles has met with any commercial success or substantial use. There are a number of reasons for the lack of success of these prior art insoles. Some of the reasons are as follows:

(1) The prior art fluid-filled insoles did not provide adequate support for the foot, thereby causing the foot to constantly hunt for a firm surface in order to maintain body balance.

(2) The prior art fluid-filled insoles caused loss of blood circulation in the foot, pinching of nerves and subsequent numbness in the toes and plantar surfaces of the foot. This was caused by the unconstrained application of fluid pressure against the medial and lateral plantar arteries, veins and nerves and also the dorsalis pedis and digital arteries, veins and nerves located in the longitudinal arch area of the foot.

(3) The prior art fluid-filled insoles were uncomforable.

(4) The prior art fluid-filled insoles were unable to maintain the fluid pressure in the insoles over an extended period of time because the fluid in the insoles would diffuse through the barrier material of which the insoles were constructed.

(5) The prior art fluid-filled insoles were difficult to manufacture and relatively expensive.

(6) The prior art fluid-filled insoles were not designed properly, at least partially because insufficient consideration was given to the technical structure of the human foot and the manner in which the bones, muscles, arteries, veins and nerves in the foot move and react during walking, jumping and running.

(7) Fluid-filled insoles inflated to pressures high enough to provide proper support for the feet are, when used by themselves, extremely uncomfortable and irritating to the feet, and may obstruct the flow of blood, bruise tendons and pinch nerves in the feet.

It has been found that one of the reasons for the deficiencies of the prior art fluid-filled insoles is that the pressures of the fluids in the insoles were too low. As a result, during walking, jumping or running the fluid in the prior art insoles was pushed away from the high load bearing areas of the foot (i.e., the heel and ball of the foot) and into areas under the sensitive portions of the foot (i.e., between the ball of the foot and the toes and under the longitudinal arch of the foot), thereby shutting off circulation in these areas. Yet, the pressure of the fluid in these prior art insoles had to be relatively low because if the pressure was too high, the fluid-filled chamber or chambers in the insole would bulge to create a bumpy, irregular, uncomfortable surface.

One patent, U.S. Pat. No. 3,120,712, suggests that a singled chamber bladder be filled to a relatively high pressure of about 30 pounds. However, the single chamber bladder of the U.S. Pat. No. 3,120,712 is incapable of supporting the internal working fluid pressure within the confines of the space allowed within the shoe, and it was necessary to provide a chamber between the inner and outer soles of the shoe and a steel plate overlying the bladder to contain it. With the bladder of the U.S. Pat. No. 3,120,712 inflated to a pressure of 30 psi, the overlying steel plate must support a force of more than 600 pounds. Accordingly, the steel plate must be extremely rigid and inflexible. As a result, the arrangement of the U.S. Pat. No. 3,120,712 will not conform to the plantar surface of the foot and will not be comfortable in use.

It has also been proposed to provide flow restricting connecting passages between fluid-filled chambers in prior art insoles. See, for example, U.S. Pat. No. 2,600,239. However, such insoles have been found to be extremely harsh to the foot and do not exhibit a comfortable "floating-on-air" sensation for the wearer. Moreover, insoles equipped with flow restricting passages are impractical from both cost and manufacturing standpoints due, in part, to the close and precise tolerances required for the sizes and shapes of the flow restricting passages.

In view of the foregoing, it is an object of the present invention to provide an improved, inflated insert or insole construction which will comfortably support the foot of a wearer and which overcomes the deficiencies and disadvantages associated with prior art inserts or insoles.

More specific objects of the present invention are as follows:

(1) To provide an improved inflated insert or insole construction which distributes the normal forces encountered when walking, jumping or running over the load-bearing portions of the plantar surface of the foot more uniformly and comfortably.

(2) To provide an improved inflated insert or insole construction which expands the normal load bearing area of the plantar surface of the foot so as to reduce pressure point loading against the foot.

(3) To provide an improved inflated insert or insole construction which forms a dynamic, self-contouring, load supporting surface which automatically and instantly shapes and contours itself to the constantly changing load bearing plantar surface of the foot.

(4) To provide an improved inflated insert or insole construction which absorbs localized forces (i.e., from stones, irregular terrain, etc.) and re-distributes these forces away from the localized area and absorbs them throughout the pressurized fluid system of the insert or insole.

(5) To provide an improved inflated insert or insole construction which protects the feet, legs, joints, body, organs, brain and circulatory system of the wearer from the damaging shock and vibration forces.

(6) To provide an improved inflated insert or insole construction which stores and returns otherwise wasted mechanical energy to the foot and leg in a manner so as to reduce the "energy of locomotion" consumed in walking, running and jumping, thereby making these activities easier and less tiring for the wearer.

(7) To provide an improved inflated insert or insole construction wherein the fluid within the insert or insole functions as a "working fluid" in a system of interconnected fluid chambers which function as fluid springs.

(8) To provide an improved inflated insert or insole construction which is capable of supporting both compression and shear forces.

(9) To provide an improved inflated insert or insole construction which exhibits pre-selected fluid spring rates in one area of the insert or insole substantially different from fluid spring rates in other parts of the insert or insole, and wherein the fluid system in the insert or insole is comprised of a multiplicity of interconnected chambers, and wherein the fluid pressure throughout all of the chambers is nominally the same at any given point in time.

(10) To provide an improved inflated insert or insole construction which converts "displacement energy" of the foot to "pressure energy" within the insert or insole, and transfers this variable pressure energy to various areas of the insert or insole to provide controlled degrees of support as required in rhythm with the varying need for support during walking, running or jumping activities of the wearer.

(11) To provide an improved inflated insert or insole construction having fluid-containing chambers in areas underlying the sensitive arch area of the foot which recede away from contact with the sensitive arch area, allowing the plantar tendons in the arch to move and flex without interference, except during selected portions of the walking or running cyle when such pressurized chambers move into supportive contact with the arch area.

(12) To provide an improved inflated insert or insole construction which provides essentially permanent, unchanging beneficial characteristics to the foot throughout the life of the article of footwear in which the insert or insole construction is incorporated.

(13) To provide an improved inflated insert or insole construction which permits easy adjustment of the level and degree of its functions by merely changing the initial inflation pressure, to thereby permit a single design to be used and optimized to fulfill a wide range of specific footwear applications, i.e., standing, walking, running, jumping, etc.

(14) To provide an improved inflated insert or insole construction which, when inflated within a specified pressure range, assumes a precise, predetermined volume, shape and surface contour in the free-standing, no-load condition.

(15) To provide an improved inflated insert or insole construction which is designed to operate at sufficiently high pressure levels such that individual fluid chambers within the insert or insole act in combination with an overlying moderator to form a complex, interconnected, pneumatic spring system capable of supporting all or a substantial portion of the body weight of the user, and which is of high durability, long life expectancy and capable of meeting or exceeding typical shoe industry standards and specifications.

(16) To provide an improved insert or insole construction inflated to a desired initial fluid pressure and in which the pressure does not drop below its initial value over an extended period, such as a period of several years. More particularly, the fluid pressure automatically increases substantially above the initial value in the early life of the insert or insole.

(17) To provide an improved inflatable insert or insole construction which may be utilized in a new and unique method of fitting a wide range of foot sizes and shapes within a relatively few sizes of articles of footwear.

The foregoing and other objects and advantages are realized by the improved insert or insole construction of the present invention which combines an inflatable insert or insole barrier member of elastomer material having a multiplicity of preferably intercommunicating, fluid-containing chambers inflated to a relatively high pressure by a gas having a low diffusion rate through the barrier member, the gas being supplemented by ambient air diffusing through the barrier member into the chambers to increase the pressure therein, the pressure remaining at or above its initial value over a period of years. A ventilated moderator bridges the chambers to more uniformally distribute the relatively high load associated with the fluid-containing chambers across the load bearing portions of the plantar surface of the foot.

Numerous other objects and advantages of the present invention will become apparent from the following specification which, together with the accompanying drawings, describes and illustrates several preferred embodiments of the present invention.

Referring to the drawings:

FIG. 7 is a light load condition, FIG. 8 is a medium load condition, and FIG. 9 a heavy load condition.

Figure 20A:
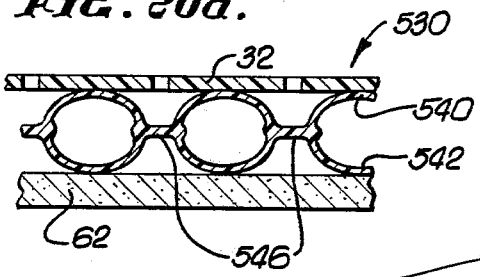
FIG. 20 is a top plan view of a further embodiment of the invention, with portions cut away.
Figure 20:
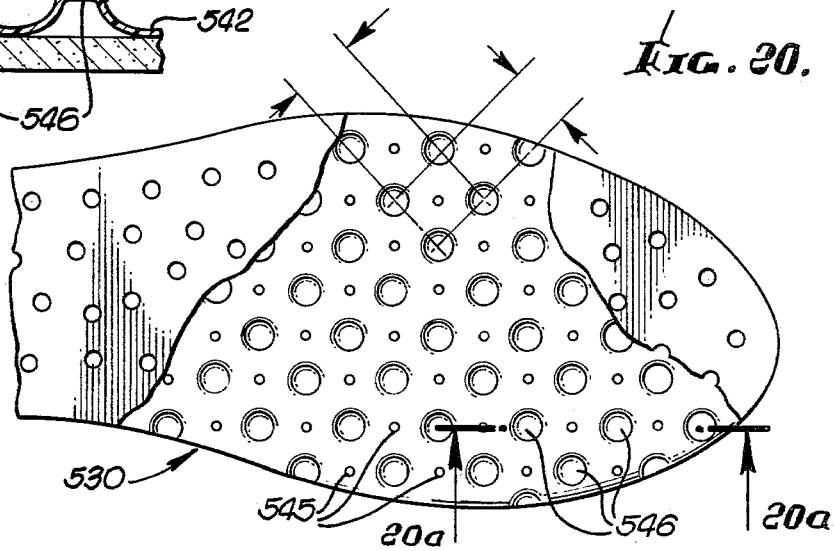

FIG. 20*a* is a longitudinal section taken along the line 20*a*—20*a* of FIG. 20.

Figure 21:
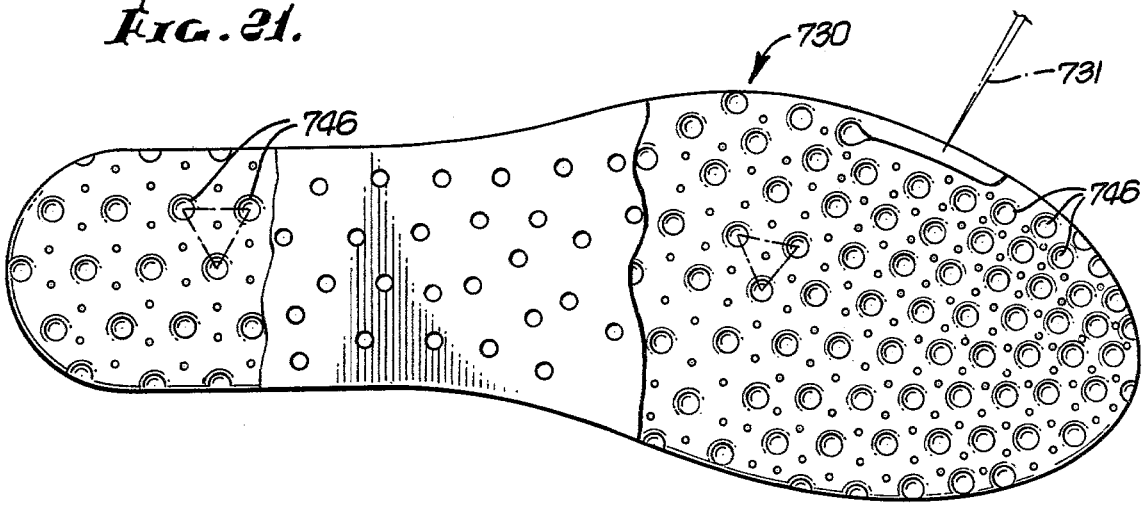

FIG. 21 is a top plan view of another embodiment of the invention.

Figure 22:
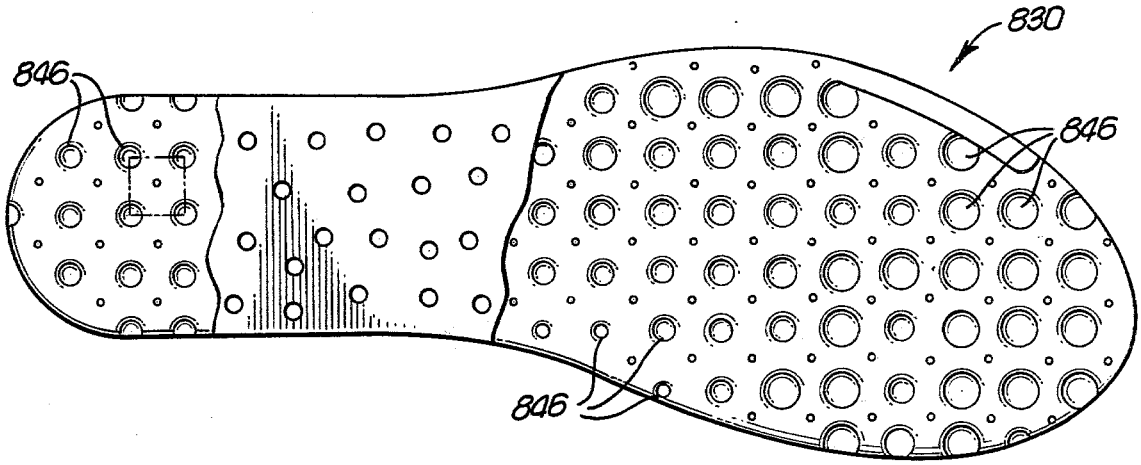

FIG. 22 is a top plan view of yet another embodiment of the invention.

Figure 23:
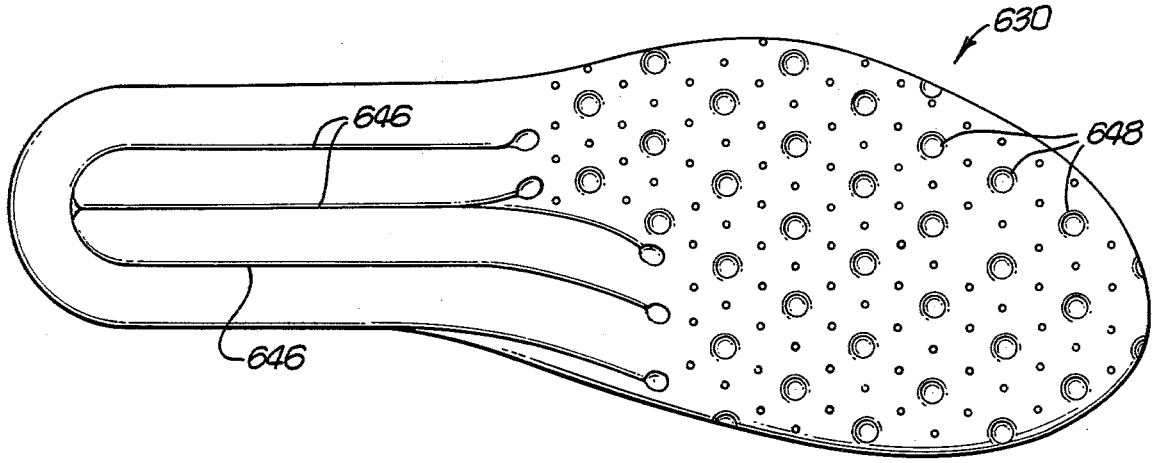

FIG. 23 is a top plan view of a further embodiment of the invention.

Figure 24:
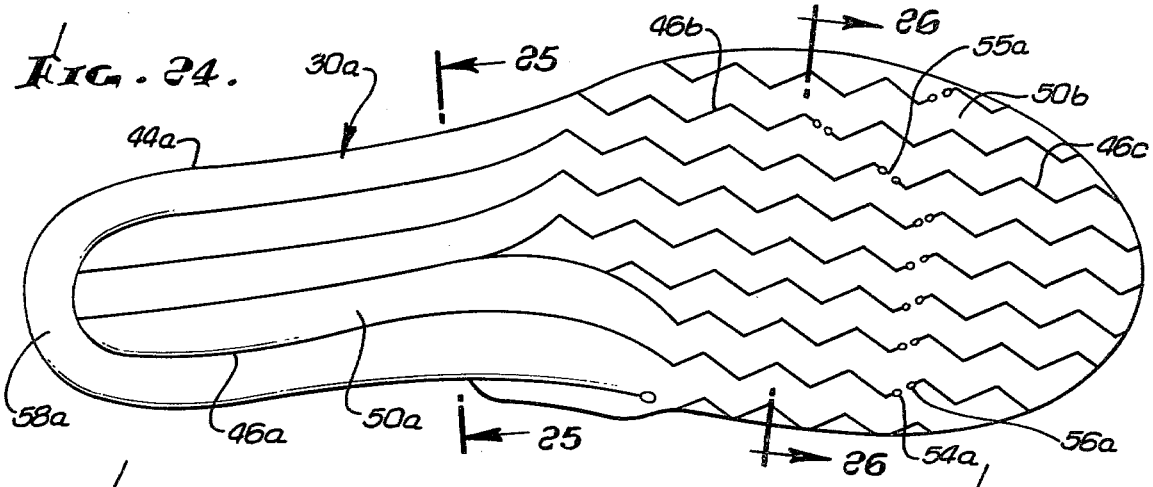

FIG. 24 is a somewhat diagramatic top plan view of another embodiment of the invention.

Figure 25:
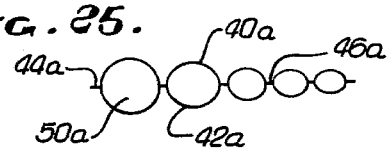

FIG. 25 is a cross-section taken along the line 25—25 on FIG. 24.

Figure 26:
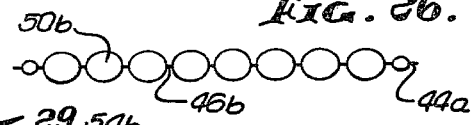

FIG. 26 is a cross-section taken along the line 26—26 on FIG. 24.

Figure 27:
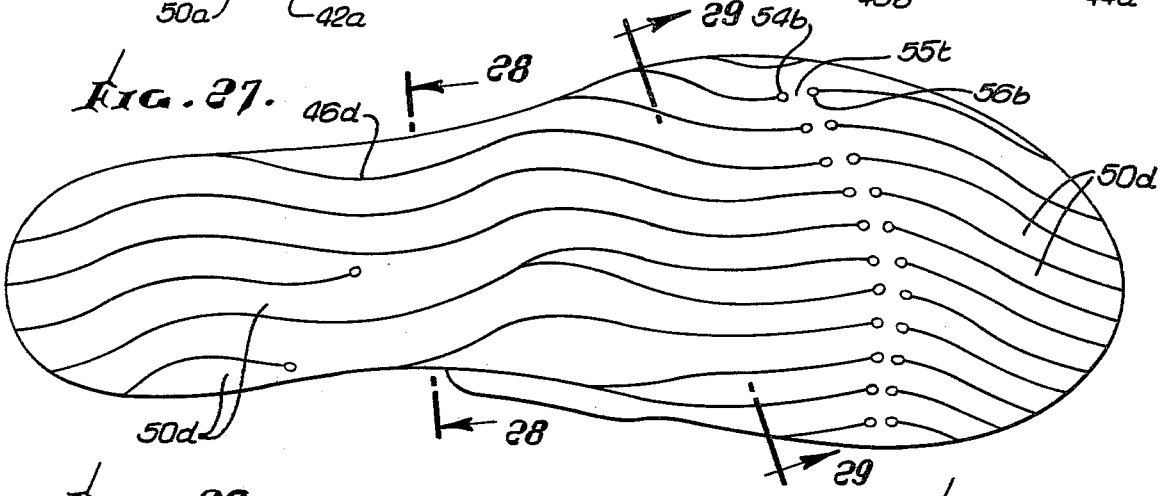

FIG. 27 is a top plan view of a further embodiment of the invention.

Figure 28:
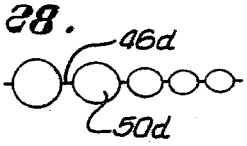

FIG. 28 is a cross-section taken along the line 28—28 on FIG. 27.

Figure 29:
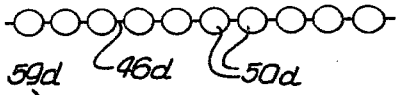

FIG. 29 is a cross-section taken along the line 29—29 on FIG. 27.

Figure 30:
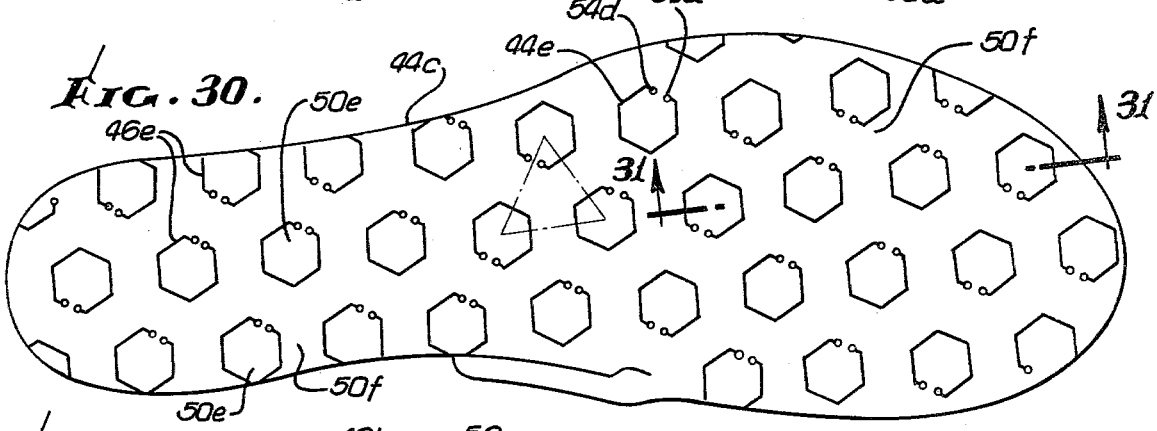

FIG. 30 is a top plan view of yet another embodiment of the invention.

Figure 31:
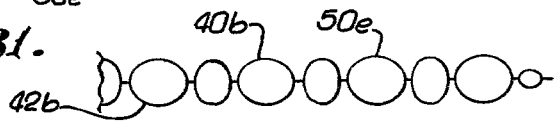

FIG. 31 is a cross-section taken along line 31—31 on FIG. 30.

Figure 32:
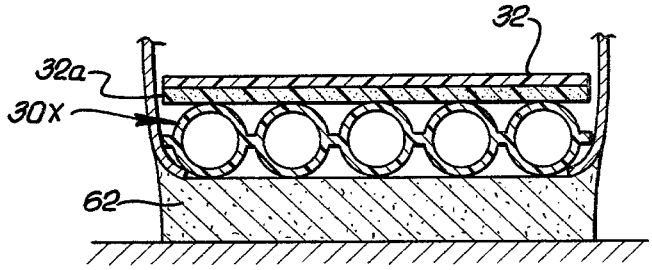

FIG. 32 is a cross-section through a portion of a shoe, disclosing a modified moderator therein.

Figure 33:
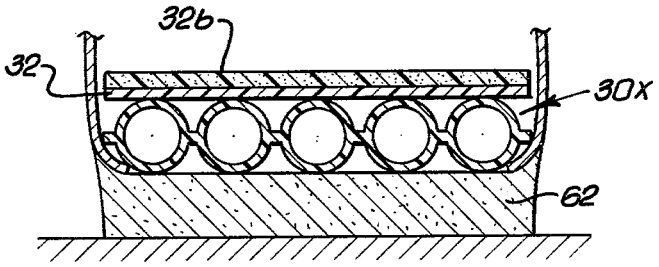

FIG. 33 is a view similar to FIG. 32 of another form of the moderator.

Figure 34:
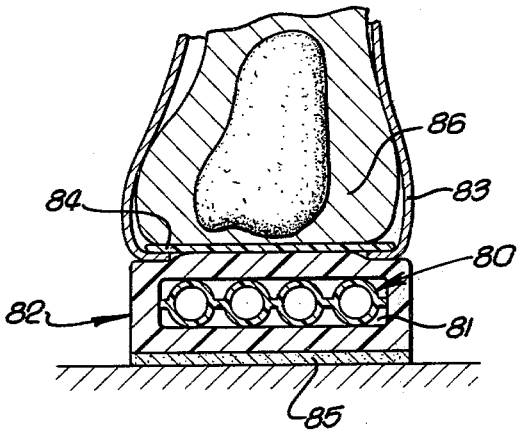

FIG. 34 is a cross-sectional view through the heel portion of the shoe, of an inflated insert or insole located within or surrounded by an outer sole, disclosed in a no-load condition.

Figure 35:
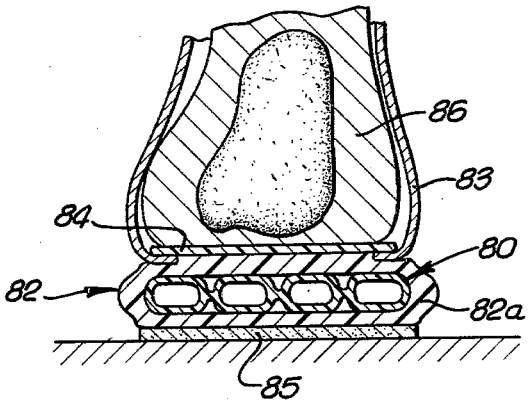

FIG. 35 is a view similar to FIG. 34 with the heel portion and insert under a loaded condition.

FIG. 36 is a graph representing the pressure conditions in a typical insole embodying the invention over a period of time.

FIG. 37 is a graph of the elongation of a film material, from which an insole embodying the invention is made, over a time period.

Figure 38:
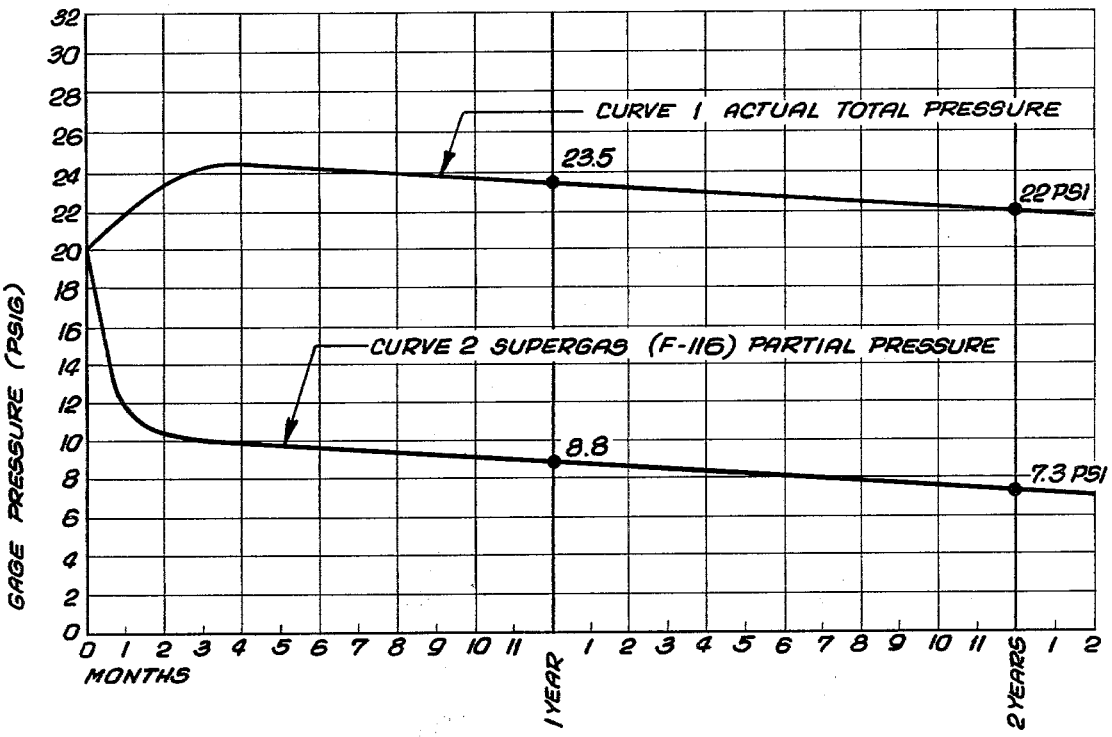

FIG. 38 is a graph illustrating the advantageous effect of self-pressurization in maintaining a desired pressure in an insole over a period of time.

Figure 39:
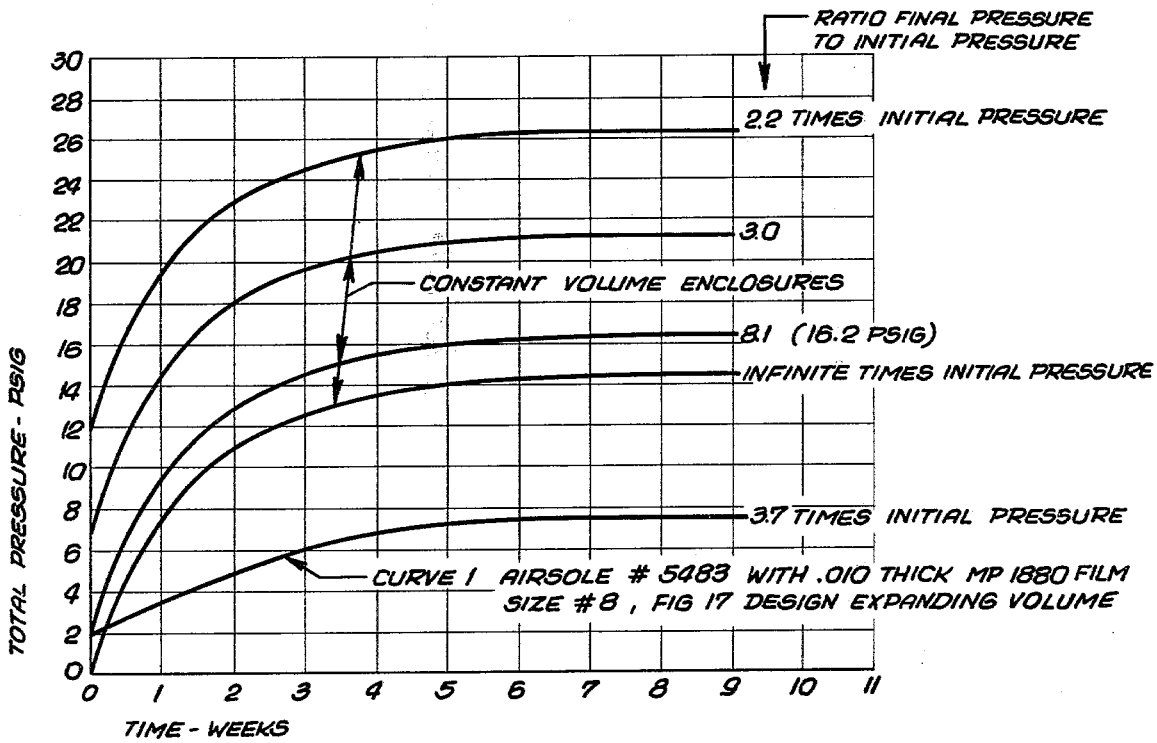

FIG. 39 is a graph illustrating the pressure rise of a particular gas over a period of time in a constant volume enclosure and elastic enclosure.

Figure 40:
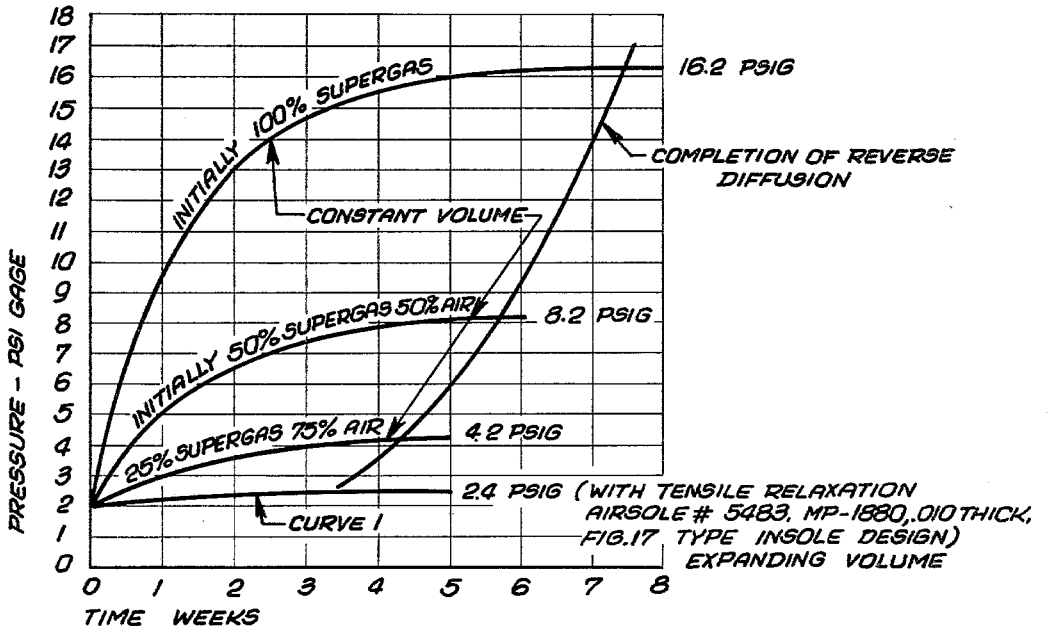

FIG. 40 is a graph showing the pressure rise of several mixtures of gases over a period of time when confined in a constant volume enclosure and in an elastic enclosure.

Figure 41:
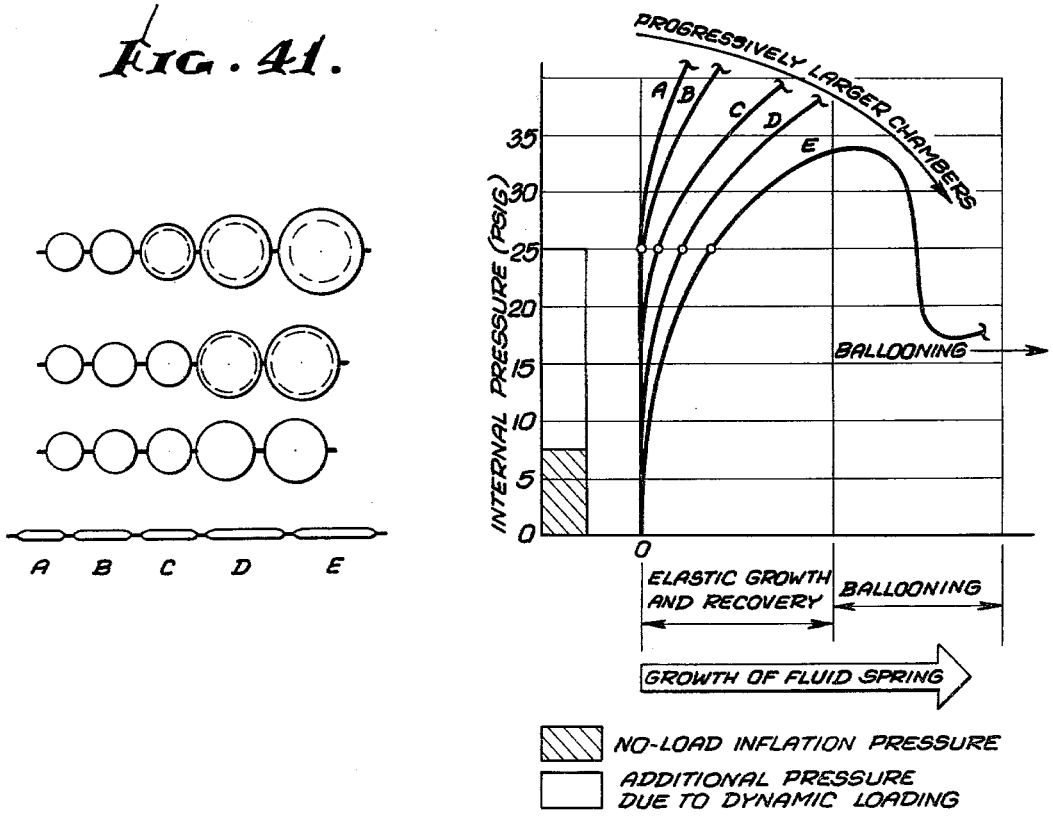

FIG. 41 is a graph showing the percentage growth in diameter for certain chambers in the insole as the fluid pressure in the insole increases.

As shown in FIGS. 1 to 5, an inflated insert 30 in the form of an insole is adapted to be placed in an article of footwear 62, 64, resting upon the outsole 62. The inflated insole 30 comprises two layers 40, 42 of an elastomeric material whose outer perimeters 44 generally conform to the outline of the human foot. The two layers of elastomeric material are sealed to one another (e.g., welded, as by a radio frequency welding operation) around the outer periphery 44 thereof and are also welded to one another along weld lines 46, 46 . . . 46, and 48, 48 . . . 48 to form a multiplicity of generally longitudinally extending, tubular, sealed chambers or compartments 50, 50 . . . 50, preferably contoured to parallel the paths of arteries, veins and tendons in the foot 52 (designated by the phantom lines in FIG. 1) and to conform to the flow of blood in the foot.

The material from which the insole is constructed may be referred to as a barrier material in that it contains a pressurized fluid or gas and forms a fluid barrier to prevent escape of the fluid or gas.

Figure 1:
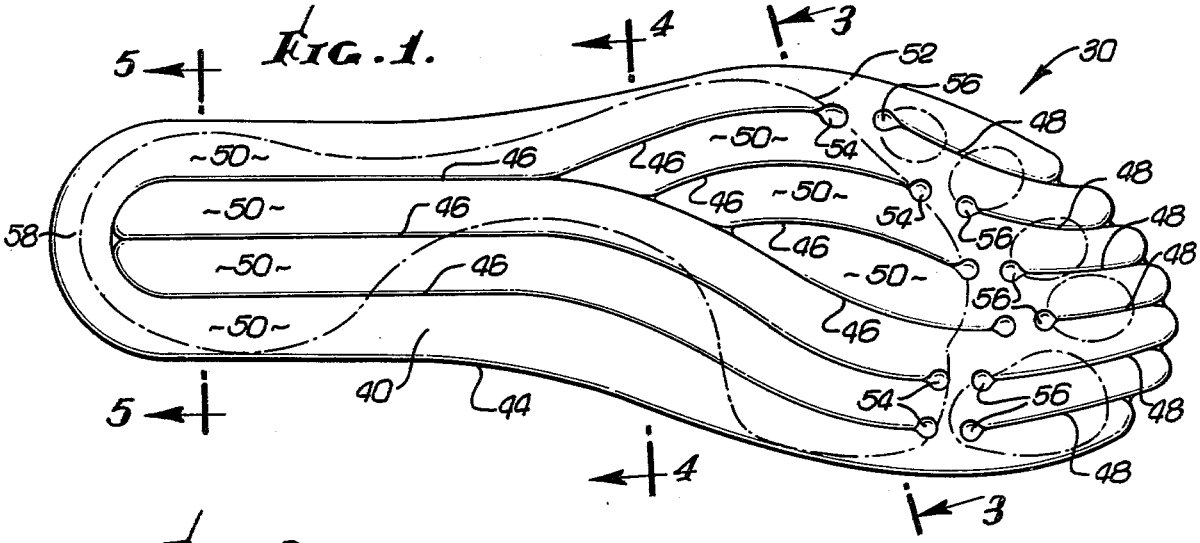
FIG. 1 is a top plan view of an embodiment of an inflated insert or insole embodying the invention showing in phantom lines a profile of the normal load bearing portions of the plantar surface of the human foot.
Figure 2:
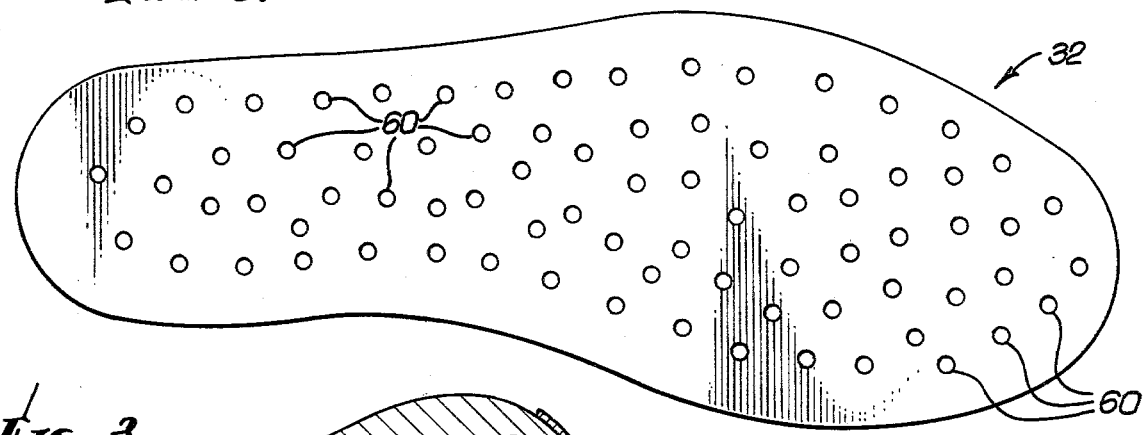
FIG. 2 is a top plan view of a ventilated moderator used in conjunction with the inflated insole of FIG. 1.

The weld lines 46 and 48 which define the tubular chambers 50 therebetween terminate at the points 54, 54 . . . 54 and 56, 56 . . . 56, which are located under non-load bearing areas of the wearer's foot 52, e.g., beneath those portions of the toes T which are connected to the ball of the foot. In FIG. 1, the profile of the normal load bearing areas of the plantar portion of a wearer's foot 52 is shown in phantom lines. The spaces 55*a* between the termination points 54, 56 provide intercommunicating passages through which the pressurized fluid can flow freely between the chambers 50, so that the pressure in all chambers is the same at any instant of time.

In the embodiment shown in FIGS. 1 and 3-5, the inside (medial) and outside (lateral) tubular chambers 50 are integrally connected to an intermediate tubular section 58 which curves around the rear portion of the inflated insole 30 to cup and underly the heel H of the wearer.

The layers 40, 42 are welded to one another at their peripheries 44 to form a sealed barrier member 30 which is inflated by a fluid to cause the intercommunicating chambers 50 to assume their tubular form. The material of the inflated insole 30 and the fluid which fills the chambers 50 are preferably selected so that the fluid will not diffuse significantly through the walls of the insole 30 over an extended period of time (e.g., several years), the insole preferably remaining inflated to support a wearer's foot 52 over a period of time longer than the life of the article of footwear in which the insole is incorporated.

The inflated tubular chambers 50 form pneumatic springs, which, in combination with the moderator 32, firmly and comfortably support the wearer's foot as the wearer stands, walks, runs or jumps.

The material from which the inflated insole 30 is constructed should have the following properties:

(1) The material should be non-porous such that there are no "pin holes" and such that the transport of the fluid which fills the chambers 50 through the material of the insole 30 is restricted to the process of "activated diffusion."

(2) The material should be elastomeric and capable of stretching within controlled limits to form a complex compound geometric shape without folds and wrinkles.

(3) The material should be capable of being easily welded, cemented, or vulcanized to form pressure tight, high strength seams (e.g., weld lines 46) which define the fluid-containing chambers 50.

(4) The material should be highly resistant to flexural fatigue.

(5) The material should be highly resistant to fungi and perspiration typical of the environment within the shoe or other article of footwear in which the improved insole construction is incorporated.

(6) The material should not contain plasticizers or other materials that would migrate from the material in service and cause toxic reactions with the skin, degradation of the properties of the material, or damage to adjacent parts of the article of footwear in which the insole is incorporated.

(7) The material should have excellent resistance to relaxation and stress when subjected to continuously high tensile forces.

(8) The material should have excellent elastic deformation and recovery characteristics without permanent set.

(9) The material should maintain the above characteristics within a temperature range of between about −30° F. to +125° F.

(10) The material should have ample strength to withstand the inflation pressures and operating pressures and conditions within the chambers 50 without damage to the material.

Considering the foregoing desired properties and requirements and the type of fluid (described below) preferably used to inflate the chambers 50 of the improved inflated insole 30 of the present invention, it has been found that the material of the insole should be selected from the following material: polyurethane, polyester elastomer (e.g., Hytrel), fluoroelastomer (e.g., Viton), chlorinated polyethylene (CPE), polyvinyl chloride (PVC) with special plasticizers, chlorosulfonated polyethylene (e.g., Hypalon), polyethylene/ethylene vinyl acetate (EVA) copolymer (e.g., Ultrathane), neoprene, butadiene acrylonitrile rubber (Buna N), butadiene styrene rubber (e.g., SBR, GR-S, Buna-S), ethylene propylene polymer (e.g., Nordel), natural rubber, high strength silicone rubber, polyethylene (low density), adduct rubber, sulfide rubber, methyl rubber, thermoplastic rubbers (e.g., Kraton).

One material which has been found to be particularly useful in manufacturing the inflated insole of the present invention is cast or extruded ether base polyurethane film having a shore "A" durometer hardness in the range of 80 to 95 (e.g., J. P. Stevens' film MP1880AE or MP1890AE natural un-pigmented in color).

The physical properties of the selected insole materials, including tensile strength, modulus of elasticity, fatigue resistance and heat-sealability are very important in a product as the insole which is subjected to an extremely demanding duty cycle when worn in a shoe for the life of the shoe. The average person walks approximately 2 to 3 miles per day which approaches 1000 miles per year. Assuming 1000 paces to the mile, the insole encounters 1,000,000 cycles per year. Each of these cycles compresses the insole to about 25 percent of its free-standing inflated height. Therefore, the insole, including the critical areas along the edges of the weld areas, is subjected to a potentially very destructive accumulation of peak stress and stress reversals. The selected materials provide the best possible endurance under these conditions. Also, and equally important, the design configurations (of FIGS. 1 to 31) are such as to minimize stress concentrations and minimize the overall stress levels on the welds (even at a maximum design 50 psi condition) so as to give the insole long inservice life in excess of the life of the shoe. Long life has been proven by 5 years of extensive testing both in actual in-shoe tests as well as in testing machines which simulate the duty cycle to greatly accelerated schedules.

The material of the insole may be reinforced with cloth or fibers, and may be laminated with other materials to achieve better overall characteristics.

The thickness of the material of the inflated insole should be between about 0.001 and about 0.050 of an inch.

The fluid which fills the pressurized chambers 50 of the inflated insole should preferably be a gas which will not diffuse appreciably through the walls of the insole material for an extended period of time (e.g., several years).

The two most desirable gases have been found to be hexafluorethane (e.g., Freon F-116) and sulfur hexafluoride.

Other gases which have been found to be acceptable, although not as good as hexafluoroethane and sulfur hexafluoride, are as follows: perfluoropropane, perfluorobutane, perfluoropentane, perfluorohexane, perfluoroheptane, octafluorocyclobutane, perfluorocyclobutane, hexafluoropropylene, tetrafluoromethane (e.g., Freon F-14), monochloropentafluoroethane (e.g., Freon F-115), 1, 2-dichlorotetrafluoroethane (e.g., Freon 114), 1, 1, 2-trichloro-1, 2, 2 trifluoroethane (e.g., Freon 113) chlorotrifluoroethylene (e.g., Genetron 1113), bromotrifluoromethane (e.g., Freon 13 B-1) and monochlorotrifluoromethane (e.g., Freon 13).

The foregoing gases may be termed "supergases" because of their unique characteristic, i.e., their unusually low diffusion rates through the elastomeric barrier material of the insert or insole.

The inflation characteristics of a supergas (hexafluoroethane—Freon F-116) in a typical insole are shown in FIG. 36. This is a relatively high pressure insole for use in athletic activities. The material is STEVENS MP-1890 AE urethane film, 0.020 inches thickness, with inflation using 100 percent supergas (F-116) at an initial pressure of 34.7 psia (20 psig). As seen in FIG. 36, Curve 1, the pressure within the enclosure rises about 4 to 5 psi during the first 2 to 4 months, and then very gradually declines during the next 2 years. At the end of 2 years, the pressure is still somewhat higher than the initial inflation pressure.

Over a 5 year period many long-term pressurization tests were conducted with the various supergases in elastomeric enclosures. They all exhibited this phenomenon of "self-pressurization," or "self-inflation," where a substantial pressure rise of 4 to 8 psi occurred during the first several months. In some cases, the pressure rise was as high as 11 to 12 psi.

The selected elastomeric films used in the insole are not good barrier materials (low permeability) for air and most gases, as are films made from such materials as MYLAR, SARAN (PVDC) and metal foil. The important properties for the insole film, which are listed above, do not include the requirement that the film be made from any of these typical barrier-type materials in order to achieve these remarkably low rates of gaseous diffusion.

Therefore, as compared to most materials classified as barriers, the material of the insole is relatively quite permeable to most gases/vapors, including the primary constituents of air, i.e., $N_2$ and $O_2$. Only the special group of gases/vapors which are defined herein as supergases exhibit very low diffusion rates through these films. These supergas diffusion rates are extremely low as is seen in Curve 2 of FIG. 36, which is the curve for the partial pressure of Freon, F-116 in a constant volume urethane enclosure. After 2 years, the partial pressure of the supergas is still as high as 80 to 90 percent of the initial starting partial pressure.

On the other hand, the $N_2$ and $O_2$ gases of the natural air environment surrounding the insole diffuse fairly rapidly into the enclosed volume until the partial pressures of these gases within the volume equals the partial pressures which exist outside the enclosure in the natural atmosphere (i.e., $N_2=11.76$ psia and $O_2=2.94$ psia).

This is highlighted in Curve 3 of FIG. 36 which gives the trend of total pressure which is made up of $N_2$, $O_2$ and supergas, within an urethane enclosure for the case of constant volume. For this case, a large pressure rise occurs, approaching 14.7 psi. The difference between the two total pressure Curves 1 and 3 is due to the stretching of the envelope under pressure, with the insole volume (Curve 1) expanding as a function of time. The insoles are designed so that the film stretches (due both to elastic deformation and permanent set resulting from tensile relaxation) an appropriate amount so as to mitigate a portion of the self-pressurization pressure rise. The control of volume growth is obtained through appropriate matching of three design parameters, i.e., modulus of elasticity of the material, thickness of the material, and the overall stress level. The stress level is a function of the type of insole pattern, i.e., tubes (FIGS. 1 and 16) or dots (FIGS. 17, 20, 21, 22) and the geometric size of the air passages.

Excessive pressure rise is detrimental to the proper functioning of the insole. It should operate within a range of pressure ±20 to ±25 percent of the average gage pressure selected to match the requirements of the specific application, i.e., high pressure for strenuous athletic activities, lower pressure for less active sports, and still lower pressures for walking, standing, etc. The objective of the predetermined and programmed volume growth is to have the pressure at the end of the self-pressurization period be at the top of the range of optimum pressure, i.e., about 20 to 25 percent above the initial starting pressure. In this way the maximum "permanent inflation" life of the insole is achieved. The slow decline in pressure due to supergas diffusion can occur over the maximum possible range of pressures (i.e., from the top of the desirable pressure range to the bottom of the pressure range). Therefore, self-pressurization contributes to "permanent" inflation in three ways: (1) adds pressurization energy to the system during the self-pressurization period, (2) raises the pressure from the initial inflation pressure (the mid-point in the range of optimum pressures) to the top of the range of optimum pressure, (3) stores fluid pressure energy in the film, as elastic deformation. This energy is then recovered as fluid pressure is lost in the system and the film contracts, reducing the internal volume and tending to maintain a more constant, uniform internal fluid pressure. Starting at the top of the pressure range prolongs to a maximum extent the time period during which the loss of pressure due to supergas diffusion can act before the pressure ultimately drops below the bottom of the band of optimum pressures.

This design feature is illustrated further in FIG. 37. In this graph, the rate of elongation of urethane film (based on suspending weights on test strips of film) is plotted as a function of time (Curves 1). Also plotted on the same time scale is the pressure rise trend of the self-pressurization phenomenon (Curve 2). As is seen, the two time-phased characteristics are similar in that one offsets the other. They also become asympototic at about the same time.

In order to highlight the importance of self-pressurization in adding pressure energy to the system, Curve 1 of FIG. 36 (total pressure within an expanding-volume insole envelope) is replotted on a gage-pressure scale as Curve 1 FIG. 38. Also plotted as Curve 2 is the partial pressure of hexafluorethane supergas (F-116) within the same expanding volume. The contribution to total pressure added by self-pressurization is indicated by the area which lies between the F-116 partial pressure Curve 2 and the total pressure Curve 1. Self-pressurization adds an increment of 14.7 psi pressure to the 100% supergas system, essentially irrespective of the initial starting pressure of the supergas. This is a large and influential increment for devices, like the insole, which operate at pressure levels from 2 to 40 psig. For example, in the FIG. 38 example, even with an expanding envelope, the total pressure (Curve 1) remains above the initial starting pressure after two years. Were it not for self-pressurization, however, the pressure would have dropped to 37 percent ($7\frac{1}{3}$ psig) of the initial pressure (supergas partial pressure Curve 2).

Two more pertinent comments can be made regarding the phenomenon of self-pressurization and FIG. 38. First, self-pressurization causes a maximum amount of air to diffuse inwardly into the inflated device. Therefore, for a given desired total pressure (air plus supergas), a minimum partial pressure of supergas is required. Because the supergas pressure is at its lowest value it will diffuse out at its slowest possible rate; this helps maintain long term pressurization at a relatively constant value. The air within the enclosure will, of course, not diffuse out at all, because the internal partial pressure is the same as the outside partial pressure of the air of the ambient atmospheric environment. Thus, the situation of having maximum air and minimum supergas within the enclosure (for a given desired total pressure) is the ideal situation for long-term constant pressurization (and "permanent" inflation).

The second comment concerns the application of external loads to the inflated insole. When load is applied, the internal pressure of both air and supergas rises. Air pressure rises above the outside air pressure and, therefore, some of the air will be forced to slowly diffuse out. (Essentially no supergas will diffuse out, unless heavy loads are applied for extremely long periods of time.) When the load is removed the device will reinflate itself again back up to the original working pressure through the mechanism of self-inflation. This self-inflation feature works effectively for a device like an inflated insole. The inflated insole has an ideal duty cycle in that the load is applied about half the time when the shoes are in use during the day, and the load is removed about half the time when the shoes are removed at night and when the wearer is sitting down while the shoes are in use. Thus, the insoles cyclically reinflate themselves to make up for the slight loss in air pressure which can occur during the periods of use.

A similar situation occurs when the insoles are taken to high altitudes, as within a suitcase in an airplane. Again some air will temporarily be forced to diffuse out, but the air will reinflate back into the insoles when the shoes are returned to lower altitudes.

This self-compensation effect with load and altitude changes is an important feature of the inflated insole.

The effect of self-pressurization is even more striking when enclosures are inflated to low initial pressure (2 psig) as in the case of inflated insoles used in street shoes for walking and standing and for orthopedic purposes. In FIG. 39, Curve 1 plots the pressure rise is an insole made from thin (0.010) lower modulus of elasticity urethane film (Stevens MP-1880). When this insole was inflated to an initial pressure of 2.0 psig with 100% supergas, the pressure rose to many times the initial pressure with the final pressure reaching 3.7 times the initial pressure after approximately 6 weeks. This large pressure rise occured even though the low modulus film stretched considerably under pressure and the internal volume of the insole increased about 40 percent. The large excursion from the 2.0 psig design pressure level is not desirable. Not only does the cushion get too firm to perform properly, but its thickness increases to such an extent that there is inadequate room for the foot in the shoe.

In low pressure enclosures, therefore, the percent pressure rise over the initial starting pressure can be very large. For instance, FIG. 39 also illustrates the present pressure rise with a constant volume enclosure for several cases of initial inflation gage pressure (i.e., zero, 2.0 psig, 7 psig, and 12 psig). The graph indicates:

| Initial Pressure (psig) 100% supergas) | Ratio Final Pressure to initial pressure |
|---|---|
| 12 (psig) | 2.2 |
| 7 | 3.0 |
| 2 | 8.1 |
| 0 | Infinite |

As mentioned, the insole made from 0.010 inch methane film (Stevens MP-1880 film) is shown to rise in pressure only 3.7 times because the volume increased approximately 40% during the time period. Had the volume been constant, it would have risen 8.1 times.

It is obvious that the achievement of an acceptably constant pressure in a low pressure insole was not possible using 100 percent supergas. Even if the initial inflation gage pressure was zero, the pressure rise would be in the order of 5 to 6 psi.

To prevent overpressurizing of the insoles, mixtures of air and supergas were used as the initial inflation medium. FIG. 40 plots the "self-pressurization" pressure rise for several mixtures of supergas and air. The graph indicates, assuming a constant volume enclosure at an initial pressure at 2.0 psig:

| % Supergas | Pressure After Self-Pressurization | Ratio Final Pressure Initial Pressure |
|---|---|---|
| 100% | 16.2 psig | 8.1 |
| 50% | 8.2 psig | 4.1 |
| 25% | 4.2 psig | 2.1 |

Also shown as Curve 1 in FIG. 40 is the pressure rise with an insole made from 0.010 MP-1880 film. With tensile relaxation, the pressure only rises from 2.0 to 2.4 psig. The corresponding volume increase is 10 to 11 percent. This is acceptable within the definition of a constant pressure insole. Thus, it can be concluded that mixtures of air and supergases can be used to achieve a long-life insole operating at low levels of constant pressure. A further approach is to initially inflate to a very low pressure (zero psig supergas) so that the enclosure is just barely distended (low volume to surface ratio). As reverse diffusion occurs, the enclosure distends further until the maximum volume to surface ratio condition is reached (still with zero tensile stress in the film). This volume change drops the partial pressure of the supergas and mitigates the subsequent self-pressurization pressure rise. However, even for this case, mixtures of air and supergas are probably required in many cases to prevent excessive pressure overshoot.

Figure 3:
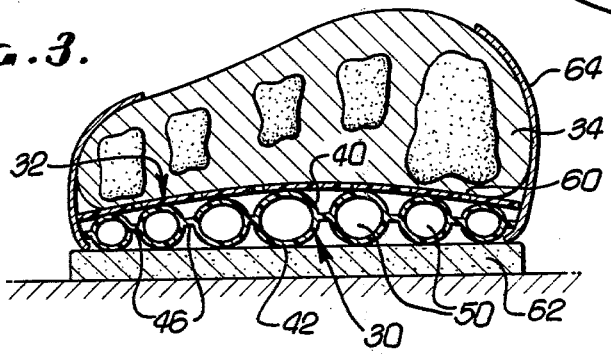
FIG. 3 is a cross-section taken along the line 3—3 on FIG. 1, of the metatarsal arch portion of the ball of the foot of a person wearing a shoe containing the inflated insole.
Figure 4:
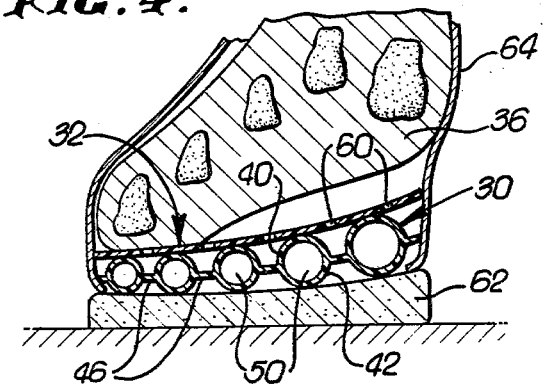
FIG. 4 is a cross-section taken along the line 4—4 of FIG. 1, of the longitudinal arch portion of the foot of a person wearing a shoe containing the inflated insole construction.
Figure 5:
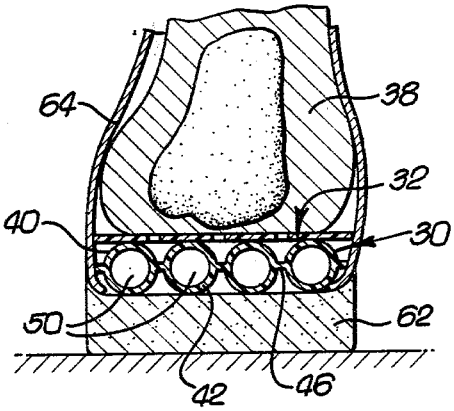
FIG. 5 is a cross-section taken along the line 5—5 cf, FIG. 1, of the heel of the foot of a person wearing a shoe containing the insole.

Returning to FIG. 1 and related Figures, the insole 30 is inflated and pressurized with a "supergas" (or another fluid, such as air or liquid, for example) after the two layers 40, 42 of the elastomeric material have been welded around the outer periphery 44 thereof and along the weld lines 46, 48 to form the multiple-chamber 50 construction shown in FIGS. 1 and 3–5. Inflation may be accomplished by inserting a hypodermic needle into one of the intercommunicating chambers 50 and connecting the needle to a source of pressurized fluid. After inflation, the hole created by the needle is sealed.

The pressure to which the chambers 50 of the insole 30 are inflated is most important. The pressure in the intercommunicating chambers 50 must be high enough to perform a supporting function for the foot, to distribute the load on the foot more uniformly across the ball bearing plantar portion of the foot so that there are no unusually high pressure points thereon. Yet, the pressure to which the insole 30 is inflated must be low enough so that the insole is comfortable to the wearer and will perform a shock absorbing function to protect the bones of the foot and body and the various body organs against shock forces which occur when the wearer is walking or running.

More specifically, the intercommunicating chambers in the insole 30 should be inflated to such a pressure that the inflation fluid performs the following functions:

(1) Distributes the normal forces associated with standing, walking, running and jumping over the load-bearing portions of the plantar surface of the foot in a relatively uniform and comfortable manner.

(2) Expands the normal load-bearing area of the plantar surface of the foot, thereby reducing the pounds per square inch loading on the foot.

(3) Creates a dynamic, self-contouring, load-supportive surface which automatically and instantly shapes and contours itself to the constantly changing load-bearing area of the plantar surface of the foot.

(4) Absorbs localized forces (e.g., from stones, irregular terrain, etc.) and re-distributes these forces away from the localized area and absorbs them throughout the pressurized fluid system of the intercommunicating chambers 50.

(5) Protects the feet, legs, joints, body, organs, brain and circulatory system of the wearer from damaging shock and vibration forces.

(6) Stores and returns otherwise wasted mechanical energy to the foot and leg in a manner so as to reduce the "energy of locomotion" consumed in walking, running, and jumping, thereby making these activities easier and less tiring for the wearer. In this regard, it should be noted that the improved inflated insole of the present invention works in concert with the natural articulated pendulum motion of the feet and legs to make walking, running and jumping easier and less tiring. Displacement energy is absorbed from the foot by the inflated insole as the foot makes initial pressure contact with the ground. This energy is converted to fluid pressure energy and stored temporarily within the inflated insole while simultaneously performing important support functions. As the foot reaches the end of its stride, when walking or running, this fluid pressure is converted back into energy of motion, assisting the foot and leg muscles in lifting the foot from the ground and swinging it forward as a pendulum into the next stride. Experienced and highly disciplined marathon runners have reported substantial improvements in speed, endurance and comfort with a concurrent reduction in pulse and respiration when testing the improved insole construction of the present invention, as compared to running the same identical course in shoes without the insole construction of the present invention.

(7) Function as a "working fluid" in a complex system of intercommunicating fluid-containing chambers.

(8) Shape the barrier material of the insole into threedimensional fluid-containing chambers of specific sizes and shapes which are capable of (a) supporting both compression and shear forces, and (b) exhibiting pre-selected spring rates in one area of the insole substantially different from spring rates in other parts of the insole.

(9) Convert "displacement energy" of the foot to "pressure energy" within the insole and transfer this variable pressure energy to selected areas of the foot (e.g., the longitudinal arch and the metatarsal arch).

It has been found that the foregoing functions are performed if the insole of the present invention is inflated to a pressure of between about 2 psi and about 50 psi. Of course, the use of the article of footwear in which the improved insole construction of the present invention is incorporated will determine the optimum pressure to which the insole should be inflated. For example, if the insole is to be employed in a pair of track shoes for a runner, the insole should be inflated to a higher pressure than if the insole construction is to be employed in a pair of ordinary street shoes. For low level athletic endeavors (e.g., jogging), the pressure to which the chambers of the insole should be inflated is between about 8 and 18 psi. For high level athletic endeavors, the inflation pressure should be between about 15 and 30 psi. For ordinary street shoes, the inflation pressure should be between about 2 and 12 psi.

As shown in FIGS. 1 and 3–5, the top surface of the inflated insole 30 has a number of peaks (at approximately the longitudinal center line of each of the tubular chambers 50) and valleys (the areas adjacent the seam lines 46 and 48) which may be uncomfortable to stand, walk, run or jump on. To eliminate such discomfort, to more uniformly spread the pressure associated with the inflated chambers 50 across the plantar surface of the wearer's foot, and to provide ventilation, the present invention contemplates the use of the ventilated moderator 32 (FIG. 2) to overlie the insole 30.

The moderator 32 consists of a sheet of semi-flexible material whose outer perimeter is in the general shape of the outline of the human foot. The moderator 32 is preferably (but not necessarily) provided with a plurality of openings or holes 60 extending therethrough. Although not specifically shown in the drawings, it is contemplated that it may be desirable to provide the holes 60 in the moderator in a pattern wherein the holes will parallel the weld lines 46 and 48 in the insole 30 to promote better ventilation around the foot of the wearer.

As best shown in FIGS. 3–5, the moderator 32 bridges the inflated tubular chambers 50 to comfort the foot of the wearer by more uniformally distributing the relative high loads associated with the fluid-containing chambers across the load-bearing portions of the plantar surface of the foot.

The moderator 32 is "semi-flexible" in that it must be flexible enough to conform to the dynamic (i.e., changing) contours of the plantar (i.e., bottom) surface of the wearer's foot. Yet, the moderator 32 must be rigid enough to bridge the tubular chambers 50.

The holes 60 in the moderator 32 permit air from between the moderator and the inflated insole 30 to circulate around the foot of the wearer as the insole is compressed under the load of the foot. As noted above, to facilitate this function, the holes 60 are preferably arranged in a pattern such that the holes parallel and overlie the seam lines 46 and 48 of the insole 30.

As best shown in FIGS. 3–5, the moderator 32 overlies the inflated insole 30. Although not shown in the drawings, it is contemplated that the moderator 32 may be secured (e.g., sewn, glued or otherwise secured) to the article of footwear in which the improved insole construction of the present invention is incorporated. This may be accomplished by securing the outer peripheral edge of the moderator 32 either to the sole 62 of the footwear (FIGS. 3-5) or between the shoe upper 64 and the sole.

It is also contemplated that the moderator 32 may be an integral part of the footwear in which the insole construction of the present invention is incorporated, in which case the inflated insole 30 would be inserted into a space or cavity provided in the sole and/or heel of the footwear beneath the moderator 32 (FIGS. 34, 35). The inflated insole 30 may be inserted into such space in the sole of the footwear during manufacture of the footwear or after manufacture. In this configuration, as the fluid springs in the insole compress and expand under a changing load, the vertical displacement of the insole may be confined predominantly within the sole and/or heel of the shoe. The foot, shoe upper and the moderator would then move together, in unison, to achieve a higher degree of lateral support than would be possible with the inflated insolemoderator combination installed on top of the sole and/or heel of the shoe.

While it is contemplated that numerous materials may be employed in making the moderator 32 of the improved insole construction of the present invention, several materials have been found to be particularly suitable, i.e., polypropylene, polyethylene, polypropylene/ethylene vinyl acetate copolymer (e.g., Profax SB 814) and polyethylene/ethylene vinyl acetate copolymer (e.g., Ultrathane 630). Other acceptable materials include "Texon" and similar materials.

The thickness of the moderator may be between about 0.005 and 0.080 of an inch.

It has been found that it may be desirable to cover the top surface (i.e., that surface which will contact the foot of the wearer) of the moderator 32 with a relatively thin (e.g., between about 0.002 and 0.020 of an inch) layer of leather, cloth, or a deformable material, such as foam, to provide additional comfort.

FIGS. 3–5 are transverse cross-sectional views taken through the metatarsal arch portion 34, the longitudinal arch portion 36, and the heel 38, respectively, of the foot of a person wearing an article of footwear equipped with the improved insole construction of the present invention. As shown in FIGS. 3–5, the inflated insole 30 is positioned in the bottom of the footwear between the sole 62 of the footwear and the wearer's foot. The ventilated moderator 32 overlies the inflated insole to bridge the inflated chambers 50 to more uniformally distribute the load across the plantar surface of the foot.

FIGS. 3–5 illustrate the condition of the improved insole construction of the present invention, (i.e., the inflated insole 30 and the moderator 32) when there is no load on the insole (e.g., when the wearer is seated). The inflated tubular chambers 50 exert substantially no load on any portion of the foot.

FIGS. 6–9 illustrate, in sequential form, the progressive loading on the longitudinal arch portion 36 of the foot of a wearer of the improved insole construction of the present invention, and the supportive function performed by the improved insole construction during walking.

Figures 6, 7, 8, 9, 10, 11, 12, 13:
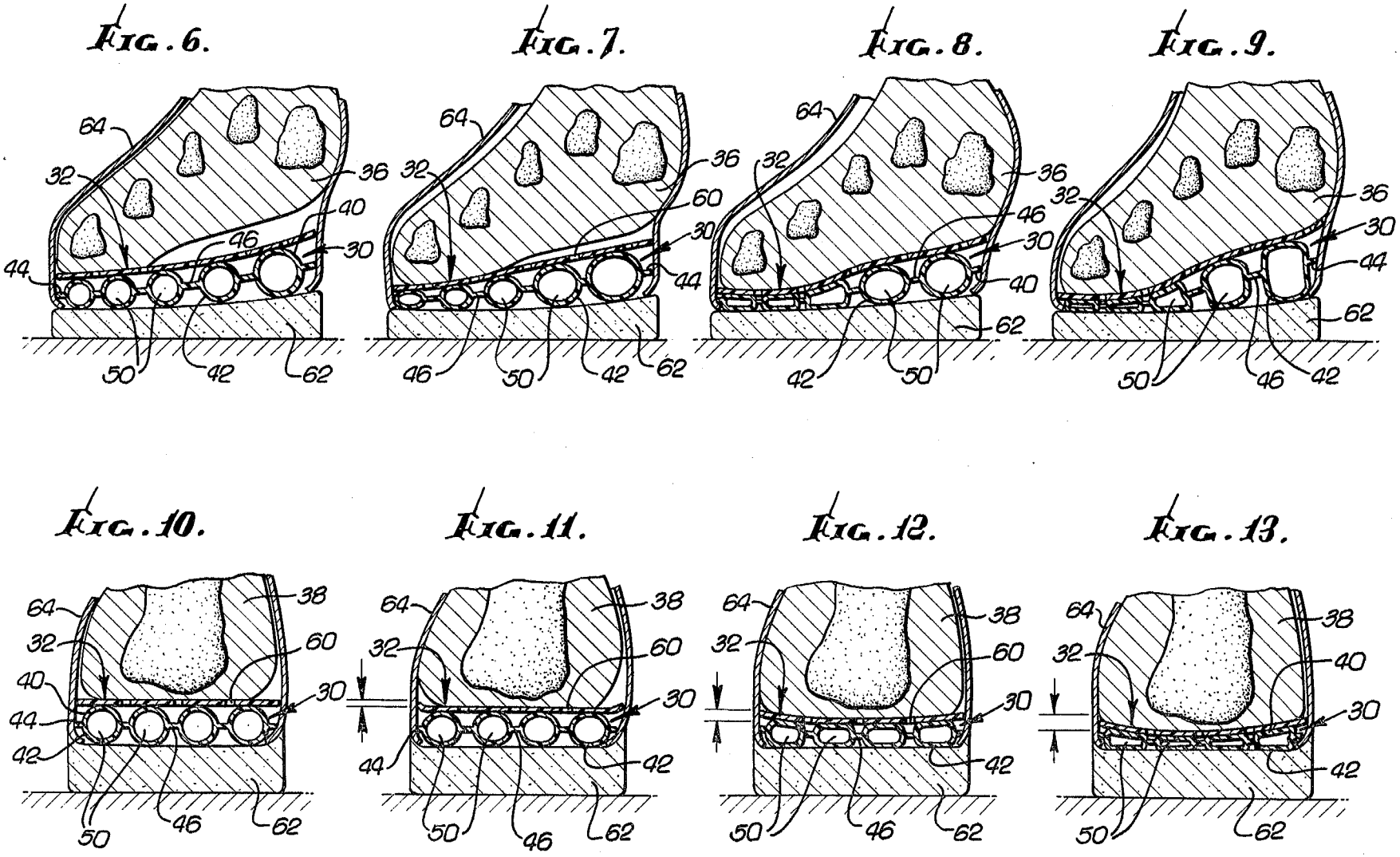
FIGS. 6–9 are cross-sections corresponding to FIG. 4, showing sequential loading of the longitudinal arch portion of the foot on the insole construction, FIG. 6 showing a no-load condition.
FIGS. 10–13 are transverse cross-sections corresponding to FIG. 5, showing sequential loading of the heel on the insole construction, FIG. 10 showing a no-load condition, FIG. 11 a light load condition, FIG. 12 a medium load condition, and FIG. 13 a heavy load condition.

As shown in FIG. 6, under no load conditions (i.e., when there is substantially no weight on the foot) only the outermost (i.e. lateral) portion of the longitudinal arch 36 is in contact with the moderator 32.

As shown in FIGS. 7, 8 and 9, as the wearer walks, the longitudinal arch portion 36 of his foot moves from a supinated position (FIG. 7) to a pronated position (FIGS. 8 and 9) wherein the full load of the body is exerted over the entire loadbearing area of the foot and the navicular bone (not shown) in the longitudinal arch portion 36 of the foot tends to roll inwardly. As this occurs, as shown in FIG. 8, the inner, sensitive portion of the longitudinal arch 36 makes contact with the improved insole construction of the present invention, the insole construction providing a pronounced arch supporting force. As additional force is exerted on the inflated insole 30, as shown in FIG. 9, the volume in the tubular chambers 50 under the normal load-bearing area of the foot decreases to increase the working pressure throughout all of chambers 50, by as much as 50 to 100% or greater. In other words, the total fluid pressure in the tubular chambers 50 increases due to the decrease in volume. This increased fluid pressure causes the adjacent, larger, more highly stressed chambers (which are in a semi-rigid elastic state) to expand and grow noticeably larger in diameter, thereby (1) filling in the space under the londitudinal arch 36, (2) bringing the moderator 32 into supportive contact with the longitudinal arch, and (3) arresting and reversing downward and rotational movement of the longitudinal arch and navicular bone of the foot.

The other smaller chambers which operate at lower levels of stress are of such size and shape as to be substantially rigid (constant size and diameter) when subjected to the maximum pressures which occur within the insole.

The "rigid" and "semi-rigid" (elastic) modes of operation are explained further in FIG. 41. The five curves on the righthand side of the figure indicate the percentage growth in diameter for chambers A, B, C, D and E as a function of internal pressure level. On the left-hand side of the figure a diagramatic representation of the geometry of the chambers is shown for several different levels of pressure, e.g., zero, 7½, 15 and 25 psig. To assist the explanation, in this figure the chambers are shown in the free-standing condition (as they would appear with no external loading). At zero pressure, of course, all chambers are essentially flat. At 7½ psig, all the chambers have been rounded-out to circular shape. However, at this pressure the elastomeric material, although under stress, has not yet been stretched or elongated any significant amount, in any of the chambers. Pressures higher than 7½ psig correspond to pressure fluctuations caused by total insole volume changes due to application of external loads (as explained above). At 15 psig the larger chambers D and E, which are the most highly stressed have started to elastically expand (stretch) to larger diameters. At this pressure, these chambers D, E are said to be operating in the "semi-rigid" (elastic) mode. Because the smaller chambers A, B and C are under less stress, they have not stretched and their diameters are essentially unchanged. These smaller chambers are said to be operating in the "rigid-mode."

At still higher pressures (25 psig) the largest chambers D and E have continued to expand at an ever faster rate. Intermediate size chamber C has started to elongate. Chambers A and B, however, are still operating in the rigid-mode at constant diameter.

The curves A, B, C, D and E on the right-hand side of the figure also illustrate the characteristics of rigid and semirigid operation. At low internal pressures all the curves for all the tubes are vertical. For this case, growth in chamber diameter with increasing pressure is essentially zero. Thus, the vertical portions of curves A, B, C, D and E corresponds to rigid-mode operation. At higher pressures the curves for the larger chambers D and E start to bend to the right, indicating an increase in diameter, with the largest chamber, E, expanding the most. At maximum working pressure (25 psig) small chambers A and B are still on the vertical portion of their curves. However, the diameters of the larger tubes C, D and E have expanded with the largest tubes D and E having expanded significantly.

If the internal pressure is increased to levels significantly in excess of maximum working pressure, the tubes will, of course, expand even further. At very high pressures, the largest chambers can be forced to stress levels which exceed the elastic limit of the material. This is indicated as "ballooning" in the figure and can result in loss of pressure and/or rupture of the material. As the curves indicate, however, a margin-of-safety is designed and built into the insoles so that the maximum expected working pressure is well below those pressures which would cause the tubes to approach their elastic limits. The margin-of-safety is more than sufficient to guard against such factors as excessive heat in the shoes, high altitute effects, etc.

The large volume increase in the system as it approaches the "ballooning" condition creates a highly effective self stabilization characteristic. By this method, excessively high fluid pressures resulting from service, heat, altitude, etc. are self-correcting so as to enhance the overall service life of the product.

It should be noted that one of the advantages of the present invention is that the improved insole construction does not make contact with the inside (medial) and central portions of the longitudinal arch when there is no substantial load on the foot (FIG. 6). This allows the tendons which extend longitudinally through the foot to move and flex freely in the longitudinal arch portion so that there is no resultant irritation of these tendons, a feature which is particularly important during the end portion or "toe-off" phase of the stride of the wearer.

FIGS. 10–13 are sequential transverse cross-sectional views taken through the heel of a wearer to show how the improved insole construction of the present invention cups the heel and provides a shock absorbing function as weight is progressively put on the heel. As shown in FIGS. 10–13, as weight is progressively put on the heel of the foot, the inflated tubular chambers 50 in the inflated insole 30 are compressed to decrease the volume therein and thereby increase the pressure of the gas contained therein. As the tubular chambers 50 are depressed under the load of the body, these chambers 50 will deflect so as to absorb pressure spikes and thereby protect the various parts (e.g., bones, organs, etc.) of the wearer's body.

As noted above, the embodiment of the inflated insole 30 of the present invention shown in FIG. 1 has its inside and outside tubular chambers 50, 50 integrally connected to one another through a rear tubular chamber 58 which encircles the rear of the wearer's heel to cup the heel. While this rear tubular section 58 adds comfort and support to the wearer, it does tend to make the rear portion of the inflated insole 30 curl somewhat.

Figure 15:
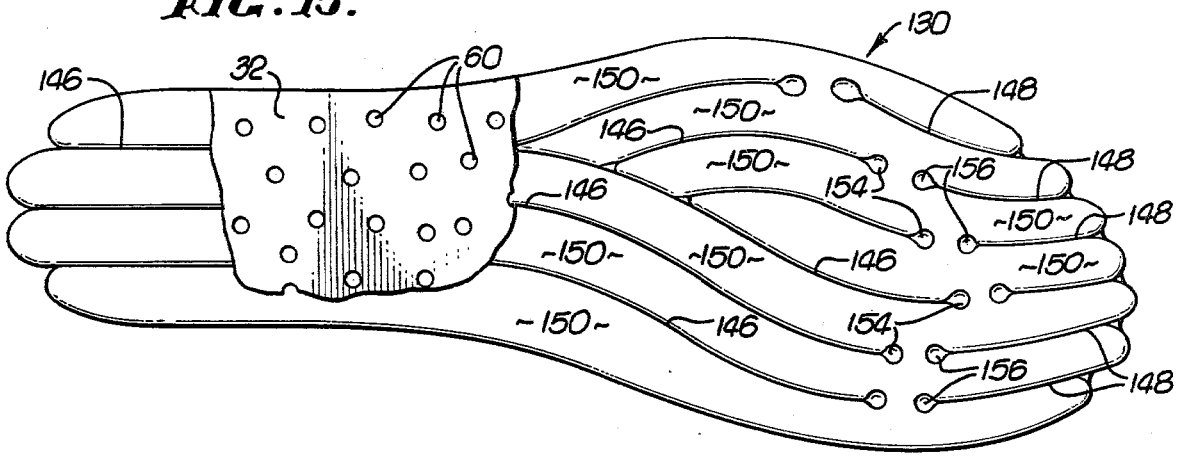
FIG. 15 is a top plan view of another embodiment of the invention.

FIG. 15 shows another embodiment of an inflated insert or insole 130 of the present invention, wherein the inside and outside tubular chambers 150, 150 do not have an interconnecting tubular section which encircles the wearer's heel. The inflated insole 130 includes a plurality of longitudinally extending tubular chambers 150, 150 . . . 150 which are defined by generally longitudinally extending weld lines 146, 146 . . . 146 and 148, 148 . . . 148. As in the case of the inflated insole 30 shown in the embodiment of FIG. 15 is formed by welding two sheets of a suitable material, e.g., polyurethane, along a peripheral seam 144 and weld lines 146, 146 . . . 146 and 148, 148 . . . 148 which terminate at weld termination points 154, 154 . . . 154 spaced from weld termination points 156, respectively, to provide spaces **155*a* for passage of fluid between chambers. As in the case of the embodiment of FIG. 1, welding of the two sheets of polyurethane of the inflated insole 130** may be carried out through a conventional radio frequency welding operation.

A ventilated moderator 32 overlies the inflated insole 130 to more uniformly distribute the load forces imposed by the inflated insole 130 across the planar surface of the wearer's foot Since the tubular chambers 150 in the inflated insole 130 shown in FIG. 15 are generally longitudinally extending, the inflated insole 130 will lie relatively flat after inflation and pressurization to facilitate ease in handling and storing of the insole, and subsequent insertion and securing of the insole construction within an article of footwear.

Figure 16:
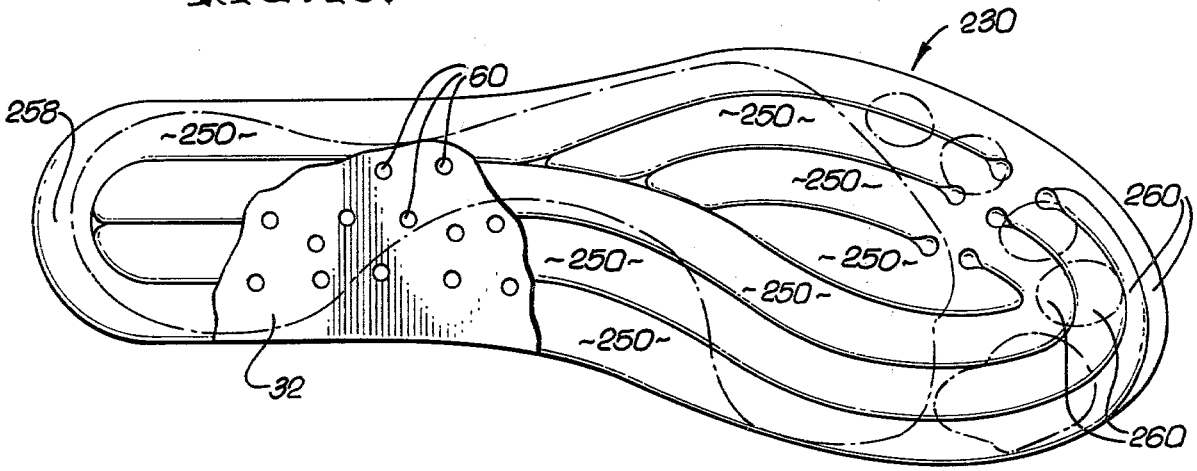
FIG. 16 is a top plan view of yet another embodiment of the invention.

FIG. 16 shows another embodiment of an inflated insert or insole 230 of the present invention wherein, like the insole 30 of the embodiment shown in FIG. 1, the inside and outside tubular chambers 250 extend rearwardly into a rear tubular chamber 258 which encircles and supports the rear portion of the heel of the wearer. In addition, the forward portions of the longitudinally extending tubular chambers 250 extend into forward curved tubular chambers 260, 260 . . . 260 which encircle the forward portion of the ball of the foot and the toes of the wearer to provide additional support beneath these portions of the foot.

As is the case with all of the embodiments of the inflated inserts or insoles, the insole 230 is adapted to be employed in conjunction with a ventilated moderator 32 which overlies the insole to more uniformly distribute across the plantar surface of the wearer's foot the forces imposed on the foot by the inflated insole.

It has been found that the insole construction of the FIG. 16 embodiment 230 provides an unusually high degree of comfort to the wearer.

Figure 17:
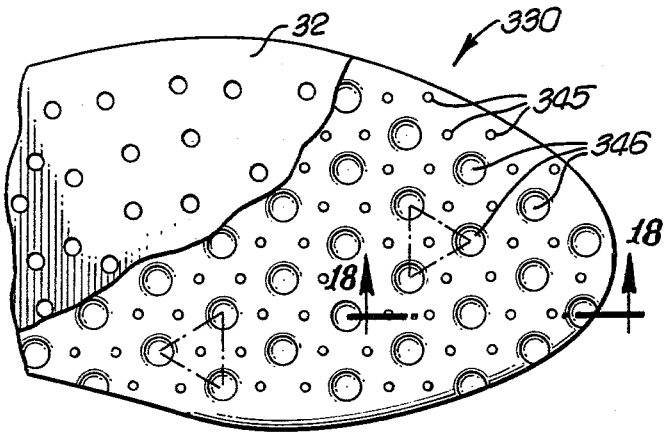
FIG. 17 is a top plan view of the forward portion of a further embodiment of the invention.
Figure 18:
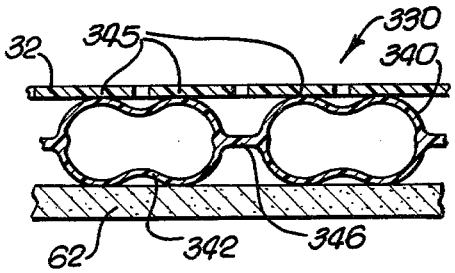
FIG. 18 is a longitudinal section, on an enlarged scale, taken along the line 18—18 of FIG. 17.

FIGS. 17 and 18 illustrate another embodiment of an inflated insert or insole 330. In the inflated insole 330, the two layers 340 and 342 of barrier material (e.g., polyurethane) from which the insole is constructed are welded together at a plurality of generally circular weld areas 346, 346 . . . 346. As shown in FIG. 17, the weld areas 346 of the inflated insole 330 are preferably arranged in triangular patterns with each weld area 346 forming an apex of an equilateral triangle.

As shown in FIGS. 17 and 18, with no load on the inflated insole 330, the inflated areas of the insole make contact with the overlying ventilated moderator 32 and the underlying sole 62 at six points 345, 345 . . . 345 around each weld area 346. These six points of contact 345 form a relatively smooth supporting ring around each of the circular weld areas 346. Thus, each weld area 346 is surrounded by an annular chamber, and the inflated insole 330 is comprised of a multiplicity of generally annular, intercommunicating chambers.

The insole construction 330 shown in FIGS. 17 and 18 tends to lie flat rather than curl. In addition, the inflated insole construction shown in FIGS. 17 and 18 picks up and supports load, (i.e., the weight of the wearer) with less deflection and, as a result, provides more firm support with excellent shock absorbing characteristics. In addition, the insole 330 (as well as the insoles disclosed in FIGS. 19–23, described below) transfers shear forces between the upper and lower layers 340 and 342 in an excellent manner, thereby minimizing lateral and forward movement of the foot relative to the sole 62 of the footwear in which the insole construction is incorporated.

Figure 19:
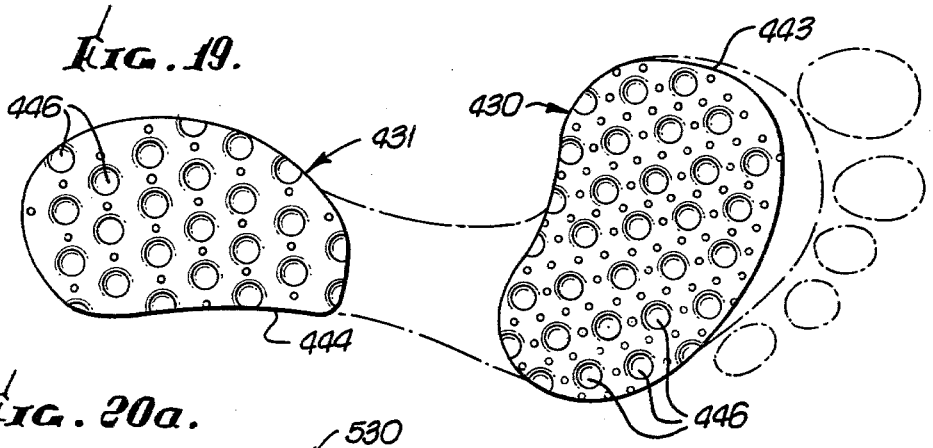
FIG. 19 is a top plan view of still another embodiment of the invention.

FIG. 19 illustrates another embodiment of the invention wherein inserts in the form of inflated peds 430 and 431 which are designed to be inserted beneath the ball and heel, respectively, of a wearer's foot, rather than a full length insert or insole which spans the entire plantar surface of the foot. Like the inflated insert or insole of FIGS. 17 and 18, the peds 430 and 431 are comprised of two layers of suitable material (e.g., polyurethane) welded together around their peripheries 443 and 444, and at a plurality of weld areas 446, 446 . . . 446 arranged in triangular patterns.

Although not specifically illustrated in the drawings, it is also contemplated that the two layers of material from which the inflated peds 430 and 431 are made may be secured together along weld lines to form longitudinally extending tubular chambers, like the chambers 50 in the insole 30 shown in FIGS. 1 and 3–5.

Inflated peds, such as peds 430 and 431 shown in FIG. 19, are less costly to manufacture than a full length insert or insole, and can be inflated to different pressures to provide different levels of support between those portions of the foot under which the peds are placed. In addition, peds take up less room than a full length insole and thus may be employed more easily in some types of footwear (such as a thin, low profile women's dress shoe).

Although a moderator is not specifically illustrated in FIG. 19, it is to be understood that one (optionally in the shape of a ped) preferably overlies each of the peds 430 and 431 to more uniformly distribute the loads imposed by the inflated peds across the ball and heel portions of the wearer's foot.

In the embodiment of FIGS. 20 and 20*a* an inflated insert or insole 530 like the embodiment shown in FIG. 17 and 18, includes two layers 540 and 542 of barrier material (e.g., polyurethane) welded together at a plurality of circular areas 546, 546 . . . 546. The circular weld areas 546 are arranged in a square pattern with each of the weld areas 546 forming one corner of a square.

When there is no load on the insole 530 (e.g., when the wearer is seated) there are four points of contact 545, 545 . . . 545 of the inflated insole with the overlying ventilated moderator and the underlying sole 62 of the footwear in which the insole construction is incorporated.

Comparing the embodiments of the inflated insole of the present invention shown in FIGS. 17 and 20, the inflated insole 530 provides a softer, "floating-on-air" sensation to the user, because the intercommunicating pneumatic chambers in the insole are somewhat fewer and further apart. The inflated insole 330 shown in FIG. 17 is somewhat firmer than the insole 530 disclosed in FIG. 20.

In the insert on insole 630 illustrated in FIG. 23, two layers of barrier material (e.g., polyurethane) are welded together along weld lines 646, 646 . . . 646 in the rear portion of the insole 630 and at spaced weld areas 648, 648 . . . 648 in the forward portion of the insole. Thus, the inflated insole 630 represents a combination of the weld pattern shown in the FIG. 1 embodiment and the weld pattern shown in the FIG. 17 embodiment. As a result the insole 630 will provide different supportive characteristics under the ball and toe areas of the foot as compared to the heel and arch areas of the foot.

Although not specifically shown in FIG. 23, it is contemplated that the inflated insole 630 will be provided with a ventilated moderator 32 (FIG. 2) overlying the inflated insole 630 to more uniformally distribute the load imposed by the inflated insole 630 across the plantar surface of the wearer's foot.

In the embodiment of FIG. 21, an inflated insert or insole 730 is disclosed which is similar to the FIG. 17 embodiment. Two layers of material are welded together at a multiplicity of circular weld areas 746, 746 . . . 746, the weld areas 746 being arranged in a pattern of triangles, with each weld area forming an apex of an equilateral triangle. However, in the FIG. 21 insole 730, the distances between the weld areas 746 vary. The distance between the weld areas 746 in the forward portion of the insole underlying the toes and the ball of the foot of the wearer are relatively close together, while the weld areas 746 in the rear portion of the insole underlying the heel of the wearer are spaced further apart. As a result of the varying spacing of the weld areas 746, the insole 730 will be thicker in the heel portion, where the weld areas are spaced further apart, and thinner in the toe portion, where the weld areas 746 are closer together. Moreover, because the spacing between the weld areas 746 is progressively less than region to region along the length of the insole 730, there is a smooth taper in the thickness of the insole from the rear of the insole to the forward portion thereof. Thus, the insole 730 is thicker in the heel area (i.e., the rear portion) where greater shock absorbing characteristics are desired, than in the front, where a more firm support is desired.

In FIG. 21, the end of a hypodermic needle 731 is shown in phantom lines as a means for inflating the insole 730.

In FIG. 22, an inflated insert or insole 830, like the insole 730 shown in FIG. 21, is designed to be thicker in the rear or heel portion than in the forward portion, to provide greater shock absorbing characteristics in the heel portion and a more firm support in the forward portion which underlies the ball and toes of the wearer's foot. This is accomplished by providing varying sizes of weld areas 846, 846 . . . 846 with uniform center-to-center spacing between the centers of the weld areas. The weld areas 846 located in the forward portion of the insole are relatively large, while the weld areas 846 in the rear or heel portion of the insole are comparatively small. As a result, the forward portion of the insole will be thinner and provide a more firm support and a softer pneumatic cushion, while the rear or heel portion of the insole will the thicker to provide greater shock absorbing characteristics.

It will be noted that the insole 830 has its weld areas 846 arranged in square patterns, with each weld area forming the corner of a square, similar to the embodiment shown in FIG. 20.

As is the case with all embodiments of the inflated insole construction previously described, the insole 830 is designed to be used in conjunction with a ventilated moderator 32 which overlies the insole to more evenly distribute the forces associated with the inflated insole 830 across the plantar surface of the foot of the wearer.

FIGS. 24 to 26, inclusive, illustrate another inflated insole 30*a* that comprise two layers 40*a*, 42*a* of an elastomeric material of a type heretofore referred to, having its outer perimeter conforming to the desired shape for appropriate reception within a person's shoe. The periphery of the insole is determined by the weld line 44*a*, and the tubular chambers 50*a*, 50*b* are formed in the same general manner as described above in connection with FIG. 1 by the spaced weld lines 46*a*, 46*b*, 46*c*, the tubular chambers being connected to an intermediate tubular section 58*a* curving around the rear portion of the inflated insole. The forward weld lines 46*b*, 46*c* are of a generally herringbone pattern, as illustrated, to provide tubular chambers 50*b* of generally zig-zag shape. The rear set of weld lines 46*b* have terminal points 54*a* spaced from opposed terminal points 56*a* of the herringbone pattern weld lines 46*c* that extend under the toe portion of the foot. The spaces 55*a* between the terminal opposed terminal points 54*a*, 56*a* provide openings or passages between adjacent tubular portions, permitting intercommunication between all of the chambers in the insole in essentially the same manner as disclosed in FIG. 1. In use, a suitable moderartor 32 will overlie the insole 30*a*.

The insoles disclosed in FIby the spaced weld lines 46*a*, 46*b*, 46*c*, the tubular chambers being connected to an intermediate tubular section 58*a* curving around the rear portion of the inflated insole. The forward weld lines 46*b*, 46*c* are of a generally herringbone pattern, as illustrated, to provide tubular chambers 50*b* of generally zig-zag shape. The rear set of weld lines 46*b* have terminal points 54*a* spaced from opposed terminal points 56*a* of the herringbone pattern weld lines 46*c* that extend under the toe portion of the foot. The spaces 55*a* between the terminal opposed terminal points 54*a*, 56*a* provide openings or passages between adjacent tubular portions, permitting intercommunication between all of the chambers in the insole in essentially the same manner as disclosed in FIG. 1. In use, a suitable moderator 32 will overlie the insole 30*a*.

The insoles disclosed in FIGS. 1, 15 and 16 tend to curl slightly when properly inflated. This tendency has little importance when the insole is removably mounted within a shoe. However, it is preferred to have an insole that lies substantially flat when permanently attached in the shoe. In the form of invention illustrated in FIG. 23, the spaced weld areas or dots 648 in the forward portion of the insole result in the insole lying flat and reduces the tendency of the tubular chambered portions 50 to curl. The reduced curling tendency enables the insole to be mounted readily in the shoe. However, the space weld areas 648 may not be capable of withstanding the repeated stresses to which they are subjected over substantial periods of time, resulting in failure at some of the weld areas.

In the form of invention illustrated in FIG. 24, the herringbone pattern of weld lines 46*b*, 46*c*, results in the insole lying substantially flat, thereby facilitating its assembly in a shoe. The rear portion of the insole may curl to a slight extent, but the herringbone front portion resists its curling and reduces it to such an extent that it does not interfere with assembly in the shoe. The herringbone-shaped weld lines are much stronger than the dot weld areas 648, and the corresponding weld regions shown in FIGS. 20, 21 and 22, resulting in the insole 30*a* having a much longer life and greater reliability. In addition, the insole is more uniform in thickness. The herringbone pattern also contributes to longer weld lines that enhances the overall strength of the weld regions considerably, making them more capable of withstanding extreme stresses that might be imposed upon them as a result of being subjected to the shock loads encountered in sporting activities, such as running and jumping.

The form of invention illustrated in FIGS. 27 to 29 is generally similar to FIGS. 24 to 26. Its weld lines 46*d* throughout the insole are of a sinusoidal shape, resulting in the insole lying flat, with its rear portion free from the curling tendency. The chambers 50*d* are in intercommunication with each other because of the spaces 55*t* provided between the confronting weld area terminals, 54*b*, 56*b*, enabling the gas pressures to be the same throughout the insole at any instant of time. The insole illustrated in FIG. 27 is strong and durable, but not quite as strong and durable as the insole shown in FIG. 24.

In the form of invention disclosed in FIGS. 30 and 31 the insole is formed, as in all the other embodiments, by upper and lower layers 40*b*, 42*b* of elastomeric material, the layers being welded to one another at the peripheral weld line 44*c*. Within this line are spaced hexagonal weld lines 46*e* arranged in a triangular pattern with respect to one another to form hexagonal chambers 50*e*. Each hexagonal weld line 44*c* has spaced terminals 54*d*, 59*d* permitting fluid communication between the interior of each hexagonal chamber 50*e* and a chamber region 50*f* surrounding the weld line. Thus, all chambers and regions intercommunicate, with a change in pressure in one portion instantly being reflected in the same fluid pressure being present in all other chamber portions of the insole. Adjacent longitudinal rows of hexagonal chambers 50*e* are offset with respect to one another, effectively forming annular chambers 50*f* around each hexagonal chamber.

The insole disclosed in FIG. 30 inherently lies flat, which facilitates its assembly in the shoe. As is true of the insoles disclosed in FIGS. 24 and 27, the design depicted in FIG. 30 has a long life and great reliability. There are less stresses imposed upon the weld lines during walking, running and jumping than occurs in the dot weld patterns shown in FIGS. 17 and 19 to 23, inclusive.

Modified forms of moderator structures are disclosed in FIGS. 32 and 33. As shown therein, an inflated insert or insole 30*x* is disposed within a shoe and bears upon its outer sole 62. The moderator structure includes a semi-flexible member 32 which has an underlay 32*a* of elastically deformable material attached thereto, such as a foam or foam-like material, which bears upon the inflated insert 30*x*, forming a cushion between the moderator member 32 and the insert. In use, the underlay 32*a* will be pressed into conformance with the insert and assist in transmitting the load between the insert 30*x* and the moderator member, preventing a slipping action from occurring between the moderator structure and the insert. Typically, the underlay 32*a* may be made of foamed elastomeric material, such as natural rubber, neoprene, polyethylene, polyethelene/ethylene vinyl acetate/copolymer, polyropylene/ethylene vinyl acetate copolymer, polyurethane, and the like.

As shown in FIG. 33, an overlay 32*b* of a foamed material can be adhered to the upper surface of the moderator member 32, with the moderator member bearing against the inflated insert 30*x*. The overlay 32*b* can be made of the same materials as the underlay 32*a* of FIG. 32. The impression of the foot are formed therein, which tends to prevent slipping of the foot relative to the overlay and moderator member. If desired, both a foamed underlay 32*a* and overlay 32*b* can be adhered to opposite sides of the moderator member 32, which is made of relatively stiff material capable of bridging the spaces between the chambers of the inflated insert or insole.

In the form of invention disclosed in FIGS. 34 and 35, an inflated insert or insole 80 is placed within a cavity 81 in the outsole or elastic heel portion 82 of a shoe having a counter 83 suitably secured to the heel portion, a conventional insole 84 resting upon the upper surface of the outer sole 82. If desired, a suitable wear surface or tread 85 is provided on the lower surface of the outer sole. As shown in FIG. 34, the heel 86 of the foot is disposed within the shoe counter 83, resting upon the insole, the outer sole 82 and the inflated insert 80 therewithin being in a no-load condition. When the heel 86 applies a load to the shoe (FIG. 35), the outer sole 82 will deflect because of its mid-portion 82*a* being made of an elastically deformable material, the insert being under compression an yielding in proportion to the compression load applied by the heel. When the load is released, the outer sole or heel 82 and the insert 80 will return to their original no-load condition, as shown in FIG. 34.

With the arrangement disclosed in FIGS. 34 and 35, an inflatable insert or insole and a moderator within the shoe counter 83 are not required. When an inflated insert 80 is located within the shoe as an insole (as in FIG. 3), the spring-like movement of the foot and inflated insert combination must be accomodated for by the upper portion 83 of the shoe. Under some circumstances, there in insufficient compliance of the shoe upper, particularly in the counter area. If excessive movement exists between the front and the inner sides of the shoe, blisters may be produced on the foot.

The above condition is corrected through the location of the inflated insert 80 within the sole or heel element 82, as shown in FIGS. 34 and 35. Since the walls of the outer sole enclosure are made of elastomerically deformable material, virtually all of the vertical displacement motion is contained within the sole and/or heel member 82. The foot 86 and shoe upper 83 move in unison, without any appreciable relative motion. In this manner, a more firm and precise supportive configuration is achieved with greater freedom from blisters being formed on the foot. With the arrangement disclosed in FIGS. 34 and 35, greater vertical displacements can be used effectively for applications involving unusually high impact forces transmitted from the foot to the adjacent shoe components.

It should be noted that each of the inflated insoles 130, 230, 330, 430, 530, 630, 730 and 830 shown in the embodiments of FIGS. 15–31, respectively, are preferably made of one of the elastomeric materials described above in conjunction with the embodiment of FIGS. 1–13, and each of the insoles is preferably inflated with one of the "supergases" described above in conjunction with the embodiment of FIGS. 1–13. In addition, the pressures to which the insoles of the embodiments of FIGS. 15–31 are inflated are preferably within the pressure ranges set forth above in conjunction with the embodiment of FIGS. 1–13.

It is contemplated that an inflatable insole constructed in accordance with the teachings of the present invention may be used in a unique method of fitting a wide range of foot sizes, shapes and widths within a given area of a boot, shoe, or other article of footwear. In this connection, it is noted that the space in a conventional boot or shoe is, in all areas tapered inwardly, including that portion of the boot or shoe which encircles the heel.

Figure 14:
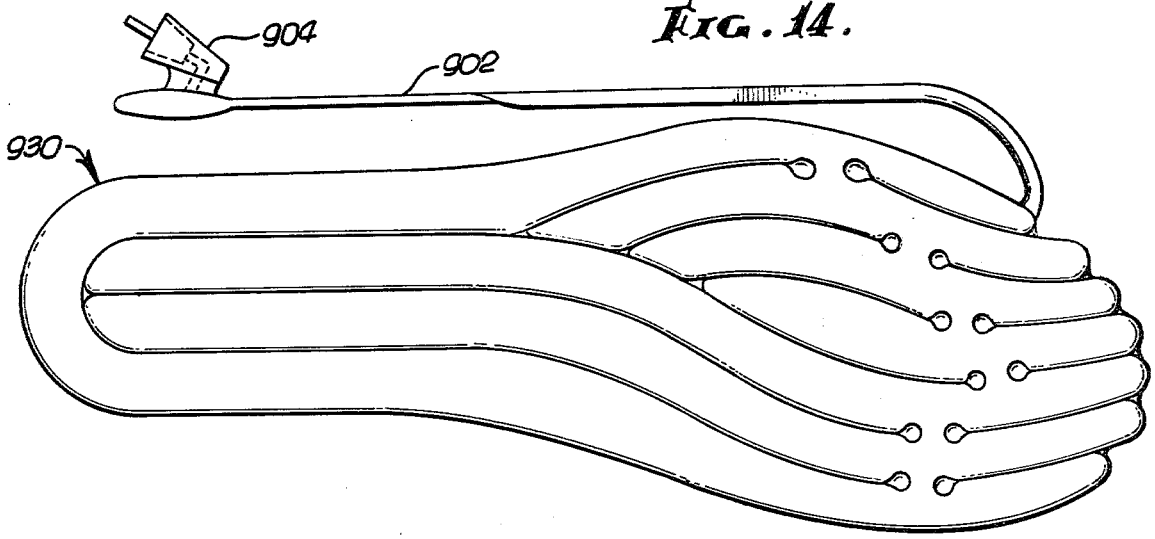
FIG. 14 is a top plan view of the embodiment shown in FIG. 1, modified to include an inflation tube and valve thereon which may be used in fitting an article of footwear (such as a ski boot, for example) on the foot of the wearer.

FIG. 14 shows an inflatable insole 930, very similar to the insole 30 shown in the embodiment of FIG. 1, provided with an inflation tube 902 having a check valve 904 connected thereto. The valve 904 is adapted to be connected to a source of fluid under pressure for inflating the insole 930.

To fit a user's foot to a particular boot, shoe or other article of footwear the insole 930 is inserted in a deflated condition in the bottom of the article of footwear. Preferably, a moderator (such as moderator 32 shown in FIG. 2) is inserted in the article of footwear overlying the inflatable insole 930. Thereafter, the wearer's foot is inserted into the article of footwear and the footwear may be tied or buckled or otherwise secured around the foot. Fluid under pressure is then introduced into the inflatable insole 930 through the valve 904 and the tubing 902. As the insole 930 is inflated, the thickness of the insole is gradually increased to gradually raise the wearer's foot upwardly into the smaller inwardly contoured portions of the footwear until a proper fit of the foot in the footwear is achieved.

There are several advantages which flow from this method of fitting an article of footwear using the inflatable insole construction of the present invention. A variety of foot sizes, shapes and widths may be fitted in a single given boot or shoe. This greatly simplifies complex fitting problems, reduces manufacturing costs (since only a few sizes of footwear need be manufactured), reduces inventory and stock costs, and reduces sales costs. In addition, this method of fitting using the inflatable insole construction of the present invention may be used for fitting footwear which has been used (e.g., "hand-me-downs" or "second-hand" footwear) on the feet of childern or adults.

The valve 904 and inflation tubing 902 may be built into the footwear to be fitted.

From the foregoing, it will be apparent that the inflated insert or insole construction of the present invention will comfortably support the foot of a wearer and gives rise to a number of advantages over the insert or insole constructions of the prior art. To name a few of these advantages:

(1) The improved construction distributes the normal forces encountered in standing, walking, running and jumping over the load-bearing portions of the plantar surface of the foot in a uniform and comfortable manner.

(2) The improved construction expands the normal load-bearing area of the plantar surface of the foot so as to reduce pressure point loading against the foot.

(3) The improved construction forms a dynamic, self-contouring, load-supporting surface which automatically and instantly shapes and contours itself to the constantly changing load-bearing area of the plantar surface of the foot.

(4) The improved construction absorbs localized forces (e.g., from stones, irregular terrain, etc.) and redistributes these forces away from the localized area and absorbs them throughout the pressurized system of the insert or insole.

(5) The improved construction protects the feet, legs, joints, body, organs, brain and circulatory system of the wearer from damaging shock and vibration forces.

(6) The improved construction stores and returns otherwise wasted mechanical energy to the foot and leg of the wearer in a manner so as to reduce the "energy of locomotion" consumed in walking, running and jumping, thereby making these activities easier and less tiring for the wearer.

(7) The improved construction provides a "working fluid" in a system of interconnected fluid chambers which, in conjunction with the moderator, function as fluid springs to absorb shock forces while providing a firm and comfortable support for the foot of the wearer.

(8) The improved construction supports both compression and shear forces encountered in walking, running and jumping.

(9) The improved construction exhibits pre-selected fluid spring rates in one area of the insert or insole substantially different from fluid spring rates in other parts of the insert or insole, and the fluid system in the insert or insole is comprised of a multiplicity of interconnected chambers wherein the fluid pressure throughout all of the chambers is nominally the same at any given point in time.

(10) The improved construction converts "displacement energy" of the foot to "pressure energy" within the insert or insole and transfers this variable pressure energy to various areas of the insert or insole to provide controlled degrees of support as required in rhythm with the increasing need for support during walking, running or jumping activities of the wearer.

(11) The improved construction has pressurized fluid-containing chambers in areas which underlie the sensitive arch area of the foot and which areas recede away from contact with the sensitive arch area to allow the plantar tendons in the arch to move and flex freely without interference except during selected portions of the walking or running cycle when the pressurized chambers move into supportive contact with the arch area.

(12) The improved construction provides essentially permanent, unchanging beneficial characteristics to the foot throughout the life of the article of footwear in which the insert or insole is incorporated.

(13) The improved construction permits easy adjustment of the level and degree of its functions by merely changing the initial inflation pressure of the insert or insole, to thereby permit a single design to be used and optimized to fulfill a wide range of specific footwear applications (i.e., standing, walking, running, jumping, etc.).

(14) The improved insert or insole construction provides a highly efficient barrier to both thermal and electrical energy.

(15) The improved construction, consisting of an inflatable insert or insole and a ventilated moderator, provides a system which forces air circulation and ventilation beneath and around the wearer's foot to reduce moisture accumulation throughout the article of footwear in which the improved insert or insole construction is incorporated.

(16) The improved insert or insole construction provides a system which massages the foot in such a way as to improve and stimulate blood circulation while the wearer is walking and running, and which does not interfere with blood flow through the foot while the wearer is standing.

(17) The improved construction is durable and reliable, and, particularly when the insert or insole is inflated with one of the "supergases" identified above in connection with the embodiment of FIGS. 1—13, the improved insert or insole construction has a life expectancy of at least several years.

(18) The improved inflated insert or insole construction, when inflated within the specified pressure range, assumes a precise, predetermined volume, shape and surface contour in the free-standing, no-load condition, so that neither the moderator nor the adjacent surfaces of the shoe are required, to achieve said free-standing shape, size and contour. In some of the embodiments of the inflated insole construction, the free-standing size and shape will approximate the contours of the plantar surface of the foot. In other of the embodiments described above, the free-standing size and shape of the inflated insert or insole may be of uniform thickness to accurately fill in specific volumes or cavities within the sole of the shoe.

(19) The improved inflated insert or insole construction is designed to operate at sufficiently high pressure levels so that the individual fluid chambers in the insert or insole act in combination with the moderator to form a complex, interconnected pneumatic spring system capable of supporting all or a substantial portion of the body weight of the wearer, and the improved insert or insole construction is of high durability, long life expectancy, and capable of meeting or exceeding typical shoe industry standards and specifications.

(20) The inflatable insert or insole construction (e.g., FIG. 14) may be utilized in a unique method of fitting a wide range of foot sizes and shapes within a relatively few sizes of articles of footwear.

(21) The insole construction of the present invention absorbs and transfers shear forces between the foot and the ground in such a manner as to reduce irritation to the plantar surface of the foot, thereby reducing problems of corns, calluses and blisters.

It is contemplated that numerous changes, modifications and/or additions may be made to the specific embodiments of the present invention shown in the drawings and described above without departing from the spirit and scope of the present invention. Accordingly, it is intended that the scope of this patent be limited only by the scope of the appended claims.

I claim:

1. An inflated insert construction for articles of footwear, comprising a sealed insert barrier member of permeable elastomeric material providing a plurality of chambers, said chambers being inflated with a gaseous medium under pressure to a desired initial value, said gaseous medium in said chambers comprising a gas other than air, oxygen or nitrogen, said elastomeric material having characteristics of relatively low permeability with respect to said gas to resist diffusion of said gas therethrough from said chambers and of relatively high permeability with respect to the ambient air surrounding said insert to permit diffusion of said ambient air through said elastomeric material into each of said chambers to provide a total pressure in each chamber which is the sum of the partial pressure of the gas in each chamber and the partial pressure of the air in each chamber, the diffusion rate of said gas through said elastomeric material being substantially lower than the diffusion rate of nitrogen through said elastomeric material.

2. An inflated insert construction according to claim 1, said ambient air diffusing through said insert member and increasing the pressure in said chambers above said initial value.

3. An inflated insert construction according to claim 1, wherein said elastomeric material of said insert member is an ether based polyurethane.

4. An inflated insert construction according to claim 1, wherein said elastomeric material of said insert is polyurethane, polyester elastomer, butyl rubber, fluoroelastomer, chlorinated polyethylene, polyvinyl chloride, chlorosulfonated polyethylene, polyethylene/ethylene vinyl acetate copolymer, neoprene, butadiene acrylonitrile rubber, butadiene styrene rubber, ethylene propylene polymer, natural rubber, high strength silicone rubber, low density polyethylene, adduct rubber, sulfide rubber, methyl rubber, or thermoplastic rubber.

5. An inflated insert construction according to claim 1, said chambers being initially inflated with a mixture of said gas and air.

6. An inflated insert construction according to claim 1, said chambers being initially inflated with a mixture of said gas and nitrogen.

7. An inflated insert construction according to claim 1, said chambers being initially inflated with a mixture of said gas and oxygen.

8. An inflated insert construction according to claim 1, the elastomeric material forming said chambers expanding, due to tensile relaxation of said material, at a rate commensurate with the diffusion of air into said chambers to provide a greater chamber volume which prevents the total pressure in said chambers from increasing excessively.

9. An inflated insert construction as defined in claim 1, said permeable material having a wall thickness of about 0.001 inch to about 0.050 inch.

10. An inflated insert construction according to claim 1, said insert barrier member being a sole member shaped to substantially conform to the outline of a person's foot.

11. An inflated insert construction according to claim 1, said chambers being in gaseous medium communication with each other.

12. A inflated insert construction according to claim 11, one or more of said inflated chambers being of such size and shape as to expand upon substantial increase in the gaseous medium pressure above said initial value, one or more other inflated chambers being of such size and shape as to resist further expansion upon such substantial increase in the gaseous medium gas pressure above said initial pressure.

13. An inflated insert construction according to claim 11, wherein said gas being either hexafluoroethane, sulfur hexafluoride, perfluoropropane, perfluorobutane, perfluoropentane, perfluorohexane, perfluoroheptane, octafluorocyclobutane, perfluorocylcobutane, hexafluoropropylene, tetrafluoromethane, monochloropentafluoroethane, 1,2-dichlorotetrafluoroethane, 1,1,2-trichloro-1,2,2, trifluoroethane, chlorotrifluoroethylene, bromotrifluoromethane, or monochlorotrifluoromethane.

14. An inflated insert construction according to claim 11, wherein said gaseous medium under pressure is hexafluoroethane.

15. An inflated insert construction according to claim 11, wherein said gaseous medium under pressure is sulfur hexafluoride.

16. An inflated insert construction according to claim 11, wherein the gaseous medium pressure in said chambers is between about 2 psi and about 50 psi.

17. An inflated insert construction according to claim 11, wherein said insert member comprises two layers of elastomeric material sealed to one another at spaced intervals to define a plurality of intercommunicating chambers.

18. An inflated insert construction according to claim 11, wherein said insert member comprises two layers of elastomeric material sealed to one another along seam lines to define a plurality of generally longitudinally extending tubular chambers.

19. An inflated insert construction according to claim 3, wherein said insole member comprises two layers of elastomeric material sealed to one another at a plurality of spaced weld areas to define a plurality of generally annular chambers.

20. An inflated insert construction according to claim 19, wherein said weld areas are arranged in a pattern of triangles, with each weld area forming an apex of a triangle.

21. An inflated insert construction according to claim 19, wherein said weld areas are arranged in a pattern of squares, with each weld area forming a corner of a square.

22. An inflated insert construction according to claim 11, wherein said insert member comprises two layers of elastomeric material sealed to one another at selected points to define said plurality of chambers, said two layers of elastomeric material being sealed to one another along seam lines in one region of said insert member to define a plurality of generally longitudinally extending tubular chambers in said one region of said insert member, and said layers of elastomeric material being sealed to one another at a plurality of spaced weld areas in another region of said insole member to define a plurality of generally annular chambers in said other region of said insert member.

23. An inflated insert construction according to claim 18, the seam lines in the forward portion of said insert being arranged in a herringbone pattern to form corresponding tubular chambers arranged in a herringbone pattern.

24. An inflated insert construction according to claim 18, the seam lines being arranged in a sinusoidal pattern to form corresponding sinusoidal tubular chambers.

25. An inflated insert construction according to claim 11, wherein said insert comprises two layers of elastomeric material sealed to one another along polygonal seam lines to form a plurality of polygonal chambers spaced from each other.

26. An inflated insole construction according to claim 11, wherein said insert comprises two layers of elastomeric material sealed to one another along hexagonal seam lines to form a plurality of hexagonal chambers spaced from one another.

27. An inflated insert construction as defined in claim 11, said permeable material having a wall thinkness of about 0.001 inch to about 0.050 inch.

28. An inflated insert construction for articles of footwear, comprising a sealed insert barrier member of permeable elastomeric material providing a plurality of chambers, said chambers being inflated with a gaseous medium under pressure to a desired initial value, said gaseous medium in said chambers comprising a gas other than air oxygen or nitrogen, said elastomeric material having characteristics of relatively low permeability with respect to said gas to resist diffusion of said gas therethrough from said chambers and of relatively high permeability with respect to the ambient air surrounding said insert to permit diffusion of said ambient air through said elastomeric material into each of said chambers to provide a total pressure in each chamber which is the sum of the partial pressure of the gas in each chamber and the partial pressure of the air in each chamber, said gas being either hexafluoroethane, sulfur hexafluoride, perfluoropropane, perfluorobutane, perfluoropentane, perfluorohexane, perfluoroheptane, octafluorocyclobutane, perfluorocyclobutane, hexafluoropropylene, tetrafluoromethane, monochloropentafluoroethane, 1,2-dichlorotetrafluoroethane, 1,1,2-trichloro-1, 2,2 trifluoroethane, chlorotrifluoroethylene, bromotrifluoromethane, or monochlorotrifluoromethane.

29. An inflated insert construction according to claim 28, said elastomeric material of said insert being either polyurethane, polyester elastomer, fluoroelastomer, chlorinated polyethylene, polyvinyl chloride, chlorosulfonated polyethylene, polyethylene/ethylene vinyl acetate copolymer, neoprene, butadiene acrylonitrile rubber, butadiene styrene rubber, ethylene propylene polymer, natural rubber, high strength silicone rubber, low density polyethylene, adduct rubber, sulfide rubber, methyl rubber, or thermoplastic rubber.

30. An inflated insert construction according to claim 28, said chambers being initially inflated with a mixture of said gas and air.

31. An inflated insert construction according to claim 28, said chambers being initially inflated with a mixture of said gas and nitrogen.

32. An inflated insert construction according to claim 28, said chambers being initially inflated with a mixture of said gas and oxygen.

33. An inflated insert construction for articles of footwear, comprising a sealed insole member of elastomeric material providing a plurality of chambers, said chambers being inflated with a fluid under pressure, and a moderator member comprising a sheet of semi-flexible material overlying said insole member and bridging said inflated chambers, said moderator member further including a layer of deformable material engaging one surface of said sheet of semi-flexible material.

34. An inflated insert construction according to claim 33, said layer being of foam material.

35. An inflated insert construction according to claim 33, said layer underlying said sheet of semi-flexible material.

36. An inflated insert construction according to claim 33, said layer overlying said sheet of semi-flexible material.

37. An insert construction according to claim 1, in combination with an elastic outsole having an enclosed cavity in which said insert is positioned.

38. An inflated insert construction according to claim 37, said chambers being in gaseous medium communication with each other.

39. An inflated insert construction for articles of footwear, comprising a sealed insole member of elastomeric material providing a plurality of chambers in fluid communication with each other, said chambers being inflated with a fluid under pressure which causes said chambers to expand and form peaks and intervening valleys in the upper surface of said member, a moderator member comprising a sheet of semi-flexible material overlying said insole member and bearing against said peaks and bridging said valleys between said inflated chambers, said fluid under pressure being either hexafluoroethane, sulfur hexafluoride, perfluoropropane, octafluorocyclobutane, perfluorocyclobutane, hexafluoropropylene, tetrafluoromethane, monochloropentafluoroethane, 1,2,-dichlorotetrafluoroethane, 1,1,2-trichloro-1,2,2 trifluoroethane, chlorotrifluoroethylene, bromotrifluoromethane, or monochlorotrifluoromethane.

40. An inflated insert construction according to claim 39, wherein said elastomeric material of said insert is either polyurethane, polyester elastomer, fluoroelastomer, chlorinated polyethylene, polyvinyl chloride, chlorosulfonated polyethylene, polyethylene/ethylene vinyl acetate copolymer, neoprene, butadiene acrylonitrile rubber, butadiene styrene rubber, ethylene propylene polymer, natural rubber, high strength silicone rubber, low density polyethylene, adduct rubber, sulfide rubber, methyl rubber, or thermoplastic rubber.

41. An inflated insert construction according to claim 29, wherein said fluid under pressure is hexafluoroethane.

42. An inflated insert construction according to claim 29, wherein said fluid under pressure is sulfur hexafluoride.

43. An inflated insert construction as defined in claim 28, said permeable material having a wall thickness of about 0.001 inch to about 0.050 inch.

44. An inflated insert construction as defined in claim 29, said permeable material having a wall thickness of about 0.001 inch to about 0.050 inch.

45. An inflated insert construction as defined in claim 13, said permeable material having a wall thickness of about 0.001 inch to about 0.050 inch.

* * * * *